US010976090B2

(12) United States Patent
Yamada et al.

(10) Patent No.: US 10,976,090 B2
(45) Date of Patent: Apr. 13, 2021

(54) AIR CONDITIONER

(71) Applicant: DAIKIN INDUSTRIES, LTD., Osaka (JP)

(72) Inventors: Takuro Yamada, Osaka (JP); Yuusuke Nakagawa, Osaka (JP); Masahiro Honda, Osaka (JP); Yuusuke Oka, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 0 days.

(21) Appl. No.: 16/338,345

(22) PCT Filed: Sep. 29, 2017

(86) PCT No.: PCT/JP2017/035687
§ 371 (c)(1),
(2) Date: Mar. 29, 2019

(87) PCT Pub. No.: WO2018/062547
PCT Pub. Date: Apr. 5, 2018

(65) Prior Publication Data

US 2019/0249912 A1 Aug. 15, 2019

(30) Foreign Application Priority Data

Sep. 30, 2016 (JP) ..... JP2016-192560

(51) Int. Cl.
*F25B 49/02* (2006.01)
*F25B 13/00* (2006.01)
(Continued)

(52) U.S. Cl.
CPC ..... *F25B 49/02* (2013.01); *F24F 1/0007* (2013.01); *F25B 1/00* (2013.01); *F25B 13/00* (2013.01);
(Continued)

(58) Field of Classification Search
CPC ..... F24F 3/065; F25B 41/043
See application file for complete search history.

(56) References Cited

U.S. PATENT DOCUMENTS 4,494,382 A * 1/1985 Raymond ..... F25B 5/00 417/280
4,720,982 A * 1/1988 Shimizu ..... F25B 13/00 62/204
(Continued)

FOREIGN PATENT DOCUMENTS

CN 101384866 A 3/2009
JP H04-169755 A 6/1992
(Continued)

OTHER PUBLICATIONS

International Search Report for PCT/JP2017/035687 (PCT/ISA/210) dated Dec. 26, 2017.
(Continued)

*Primary Examiner* — Filip Zec
(74) *Attorney, Agent, or Firm* — Birch, Stewart, Kolasch & Birch, LLP

(57) ABSTRACT

An air conditioner includes: liquid-side indoor expansion valves corresponding to a liquid side of respective indoor heat exchangers; and gas-side indoor expansion valves corresponding to a gas side of the respective indoor heat exchangers. In a case where both a heating-operation indoor heat exchanger and a heating-stopped indoor heat exchanger are present, the controller of the air conditioner controls the liquid-side indoor expansion valve and the gas-side indoor expansion valve corresponding to the heating-stopped indoor heat exchanger such that an opening degree of the gas-side indoor expansion valve becomes smaller than an opening degree of the liquid-side indoor expansion valve.

21 Claims, 12 Drawing Sheets

(51) Int. Cl.

| | |
|---|---|
| ***F25B 41/04*** | (2006.01) |
| ***F24F 1/0007*** | (2019.01) |
| ***F25B 1/00*** | (2006.01) |

(52) U.S. Cl.

CPC ..... *F25B 41/04* (2013.01); *F25B 2313/0233* (2013.01); *F25B 2341/0662* (2013.01); *F25B 2400/13* (2013.01); *F25B 2600/2513* (2013.01); *F25B 2700/21152* (2013.01)

(56) References Cited

U.S. PATENT DOCUMENTS

| | | | | | |
|---|---|---|---|---|---|
| 4,771,610 | A * | 9/1988 | Nakashima | F25B 5/00 | 62/160 |
| 4,878,357 | A * | 11/1989 | Sekigami | F24F 3/065 | 62/160 |
| 5,107,684 | A * | 4/1992 | Nakayama | F24F 3/065 | 62/81 |
| 5,142,877 | A * | 9/1992 | Shimizu | F24F 3/065 | 62/129 |
| 5,263,333 | A | 11/1993 | Kubo et al. | | |
| 5,343,935 | A * | 9/1994 | Sumitani | F25B 13/00 | 165/207 |
| 7,600,389 | B2 * | 10/2009 | Kim | F24F 3/065 | 62/200 |
| 9,010,135 | B2 * | 4/2015 | Kawano | F25B 13/00 | 62/174 |
| 9,010,137 | B2 * | 4/2015 | Sugiyama | F24F 3/065 | 62/228.1 |
| 9,518,755 | B2 * | 12/2016 | Toya | F24F 1/0003 | |
| 9,581,365 | B2 * | 2/2017 | Furui | F25B 13/00 | |
| 9,719,708 | B2 * | 8/2017 | Okano | F25B 13/00 | |
| 2009/0056358 | A1 | 3/2009 | Kotani et al. | | |
| 2013/0019613 | A1 * | 1/2013 | Lee | F25B 13/00 | 62/56 |
| 2016/0238290 | A1 * | 8/2016 | Bae | F25B 41/04 | |

FOREIGN PATENT DOCUMENTS

| | | | |
|---|---|---|---|
| JP | H07-310962 | A | 11/1995 |
| JP | H08-086527 | A | 4/1996 |
| JP | H09-042792 | A | 2/1997 |

OTHER PUBLICATIONS

Written Opinion of the International Searching Authority for International Application No. PCT/JP2017/035687, dated Dec. 26, 2017 with English translation.

* cited by examiner

AIR CONDITIONER

TECHNICAL FIELD

The present invention relates to air conditioners, and particularly to an air conditioner including a refrigerant circuit and a control unit. The refrigerant circuit is constituted by connecting a compressor, a plurality of indoor heat exchangers that are parallel with each other, liquid-side indoor expansion valves corresponding to a liquid side of the respective indoor heat exchangers, and an outdoor heat exchanger. The control unit performs heating operation in which refrigerant sealed in the refrigerant circuit is circulated in the order of the compressor, the indoor heat exchangers, the liquid-side indoor expansion valves, and the outdoor heat exchanger.

BACKGROUND ART

There has been an air conditioner including a refrigerant circuit and a control unit, the refrigerant circuit being constituted by connecting a compressor, a plurality of indoor heat exchangers that are parallel with each other, liquid-side indoor expansion valves corresponding to a liquid side of the respective indoor heat exchangers, and an outdoor heat exchanger, the control unit performing heating operation in which refrigerant sealed in the refrigerant circuit is circulated in the order of the compressor, the indoor heat exchangers, the indoor expansion valves (hereinafter referred to as "liquid-side indoor expansion valves"), and the outdoor heat exchanger. As such an air conditioner, as described in PTL 1 (Japanese Unexamined Patent Application Publication No. 7-310962), in a case where the plurality of indoor heat exchangers include both a heating-operation indoor heat exchanger that performs heating operation and a heating-stopped indoor heat exchanger that does not perform heating operation, in order to suppress accumulation of refrigerant in the heating-stopped indoor heat exchanger, the liquid-side indoor expansion valve corresponding to the heating-stopped indoor heat exchanger is controlled to be slightly open so that a small amount of refrigerant flows into the heating-stopped indoor heat exchanger. Alternatively, instead of controlling the liquid-side indoor expansion valve to be slightly open, an expansion mechanism (formed by using a capillary tube and a check valve) that bypasses the liquid-side indoor expansion valve is provided so that a small amount of refrigerant flows into the heating-stopped indoor heat exchanger through the expansion mechanism in a state where the liquid-side indoor expansion valve is closed.

SUMMARY OF THE INVENTION

It is possible to suppress accumulation of refrigerant in the heating-stopped indoor heat exchanger by controlling the liquid-side indoor expansion valve to be slightly open according to PTL 1 or using the expansion mechanism that bypasses the liquid-side indoor expansion valve. However, since high-pressure refrigerant flows into the heating-stopped indoor heat exchanger, the refrigerant releases heat in the heating-stopped indoor heat exchanger, which is a radiation loss from the heating-stopped indoor heat exchanger.

An object of the present invention is, in a case where the plurality of indoor heat exchangers include both the heating-operation indoor heat exchanger that performs heating operation and the heating-stopped indoor heat exchanger that does not perform heating operation, to suppress the radiation loss from the heating-stopped indoor heat exchanger when suppressing accumulation of refrigerant by causing the refrigerant to flow into the heating-stopped indoor heat exchanger.

An air conditioner according to a first aspect includes a refrigerant circuit and a controller. The refrigerant circuit is constituted by connecting a compressor, a plurality of indoor heat exchangers that are parallel with each other, liquid-side indoor expansion valves corresponding to a liquid side of the respective indoor heat exchangers, and an outdoor heat exchanger. The controller performs a heating operation in which refrigerant sealed in the refrigerant circuit is circulated in an order of the compressor, the indoor heat exchangers, the liquid-side indoor expansion valves, and the outdoor heat exchanger. Note that the refrigerant circuit further includes gas-side indoor expansion valves corresponding to a gas side of the respective indoor heat exchangers. Furthermore, in a case where the indoor heat exchangers include both a heating-operation indoor heat exchanger that performs the heating operation and a heating-stopped indoor heat exchanger that does not perform the heating operation, the controller controls the liquid-side indoor expansion valve and the gas-side indoor expansion valve corresponding to the heating-stopped indoor heat exchanger such that an opening degree of the gas-side indoor expansion valve becomes smaller than an opening degree of the liquid-side indoor expansion valve. The phrase "not perform heating operation" herein means a state in which the operation of an indoor unit including an indoor heat exchanger is stopped or a state in which the indoor unit is in a thermo-off state, and the term "heating-stopped indoor heat exchanger" means the indoor heat exchanger of the indoor unit in this "not perform heating operation" state.

When a small amount of refrigerant flows into the heating-stopped indoor heat exchanger by controlling the liquid-side indoor expansion valve to be slightly open or using the expansion mechanism that bypasses the liquid-side indoor expansion valve according to the related art, the refrigerant is not decompressed on the upstream side of the heating-stopped indoor heat exchanger, and the refrigerant is decompressed to a great extent on the downstream side of the heating-stopped indoor heat exchanger. Thus, as in the heating-operation indoor heat exchanger, the high-pressure refrigerant discharged from the compressor also flows into the heating-stopped indoor heat exchanger. Furthermore, the high-pressure refrigerant discharged from the compressor has a much higher temperature than an atmosphere temperature of the heating-stopped indoor heat exchanger, which leads to generation of a radiation loss from the heating-stopped indoor heat exchanger.

Therefore, herein, the gas-side indoor expansion valves are provided at the gas side of the respective indoor heat exchangers as described above. In a case where both the heating-operation indoor heat exchanger and the heating-stopped indoor heat exchanger are present, the liquid-side indoor expansion valve and the gas-side indoor expansion valve corresponding to the heating-stopped indoor heat exchanger are controlled such that the opening degree of the gas-side indoor expansion valve becomes smaller than the opening degree of the liquid-side indoor expansion valve. When the liquid-side indoor expansion valve and the gas-side indoor expansion valve are controlled in the above manner, the refrigerant is decompressed to a great extent on the upstream side of the heating-stopped indoor heat exchanger compared with that on the downstream side of the heating-stopped indoor heat exchanger. Thus, a small amount of refrigerant at a low pressure, compared with the high-pressure refrigerant discharged from the compressor, flows into the heating-stopped indoor heat exchanger. Accordingly, herein, the temperature of refrigerant flowing in the heating-stopped indoor heat exchanger can be decreased to approach the atmosphere temperature of the heating-stopped indoor heat exchanger. As a result, the radiation loss from the heating-stopped indoor heat exchanger can be suppressed.

In the above manner, herein, in order to suppress accumulation of refrigerant, in a case where both the heating-operation indoor heat exchanger and the heating-stopped indoor heat exchanger are present, by causing a small amount of refrigerant to flow into the heating-stopped indoor heat exchanger, the gas-side indoor expansion valve is provided and controlled such that the opening degree of the gas-side indoor expansion valve becomes smaller than the opening degree of the liquid-side indoor expansion valve. As a result, the radiation loss from the heating-stopped indoor heat exchanger can be suppressed.

According to an air conditioner according to a second aspect, in the air conditioner according to the first aspect, the controller controls the gas-side indoor expansion valve corresponding to the heating-operation indoor heat exchanger such that the opening degree of the gas-side indoor expansion valve becomes fully open.

In this case, unlike in the heating-stopped indoor heat exchanger, the gas-side indoor expansion valve corresponding to the heating-operation indoor heat exchanger is controlled such that the opening degree of the gas-side indoor expansion valve becomes fully open as described above. Thus, the high-pressure refrigerant discharged from the compressor can directly flow into the heating-operation indoor heat exchanger.

Accordingly, in this case, as for the heating-operation indoor heat exchanger, it is possible to perform heating operation as in a case where all the indoor heat exchangers perform heating operation and in a case of a configuration of the related art in which the gas-side indoor expansion valves are not provided.

According to an air conditioner according to a third aspect, in the air conditioner according to the first or second aspect, the controller controls the gas-side indoor expansion valve corresponding to the heating-stopped indoor heat exchanger such that the opening degree of the gas-side indoor expansion valve becomes slightly open. The term "slightly open" herein corresponds to an opening degree of about 15% or less when a fully open state of the gas-side indoor expansion valve is 100%.

In this case, the gas-side indoor expansion valve corresponding to the heating-stopped indoor heat exchanger is controlled such that the opening degree thereof becomes slightly open as described above. Thus, a small amount of refrigerant is decompressed to a great extent on the upstream side of the heating-stopped indoor heat exchanger, and a small amount of refrigerant at a sufficiently low pressure, compared with the high-pressure refrigerant discharged from the compressor, flows into the heating-stopped indoor heat exchanger.

Accordingly, in this case, the temperature of refrigerant flowing in the heating-stopped indoor heat exchanger can further approach the atmosphere temperature of the heating-stopped indoor heat exchanger, and the radiation loss from the heating-stopped indoor heat exchanger can be sufficiently suppressed.

According to an air conditioner according to a fourth aspect, in the air conditioner according to any one of the first to third aspects, the controller controls the liquid-side indoor expansion valve corresponding to the heating-stopped indoor heat exchanger such that the opening degree of the liquid-side indoor expansion valve becomes fully open.

In this case, as described above, the liquid-side indoor expansion valve corresponding to the heating-stopped indoor heat exchanger is controlled such that the opening degree thereof becomes fully open. Thus, refrigerant at the same pressure as the refrigerant that has been decompressed by the liquid-side indoor expansion valve corresponding to the heating-operation indoor heat exchanger flows into the heating-stopped indoor heat exchanger.

Accordingly, in this case, the temperature of refrigerant flowing in the heating-stopped indoor heat exchanger can further approach the atmosphere temperature of the heating-stopped indoor heat exchanger, and the radiation loss from the heating-stopped indoor heat exchanger can be sufficiently suppressed.

According to an air conditioner according to a fifth aspect, in the air conditioner according to any one of the first to fourth aspects, the refrigerant circuit further includes an outdoor expansion valve between the liquid-side indoor expansion valves and the outdoor heat exchanger, and the controller controls an opening degree of the outdoor expansion valve such that the temperature of refrigerant in the heating-stopped indoor heat exchanger becomes lower than or equal to an atmosphere temperature of the heating-stopped indoor heat exchanger.

In order to reliably suppress the radiation loss from the heating-stopped indoor heat exchanger, the temperature of refrigerant flowing in the heating-stopped indoor heat exchanger may be made lower than or equal to the atmosphere temperature of the heating-stopped indoor heat exchanger. Meanwhile, the temperature of refrigerant flowing in the heating-stopped indoor heat exchanger fluctuates by being influenced by a pressure of refrigerant flowing between the liquid-side indoor expansion valve and the outdoor heat exchanger. Accordingly, for example, in a case where a saturation temperature corresponding to the pressure of refrigerant flowing between the liquid-side indoor expansion valve and the outdoor heat exchanger is much higher than the atmosphere temperature of the heating-stopped indoor heat exchanger, even if the opening degrees of the liquid-side indoor expansion valve and the gas-side indoor expansion valve are controlled in the above manner, it is not possible to make the temperature of refrigerant flowing in the heating-stopped indoor heat exchanger become lower than or equal to the atmosphere temperature of the heating-stopped indoor heat exchanger in some cases.

Therefore, in this case, in a case where both the heating-operation indoor heat exchanger and the heating-stopped indoor heat exchanger are present, the opening degrees of the liquid-side indoor expansion valve and the gas-side indoor expansion valve are controlled, and also the opening degree of the outdoor expansion valve is controlled such that the temperature of refrigerant flowing in the heating-stopped indoor heat exchanger becomes lower than or equal to the atmosphere temperature of the heating-stopped indoor heat exchanger.

Thus, in this case, it is possible to make the temperature of refrigerant flowing in the heating-stopped indoor heat exchanger become lower than or equal to the atmosphere temperature of the heating-stopped indoor heat exchanger so that the radiation loss from the heating-stopped indoor heat exchanger can be reliably suppressed.

According to an air conditioner according to a sixth aspect, in the air conditioner according to any one of the first to fourth aspects, the refrigerant circuit further includes an outdoor expansion valve between the liquid-side indoor expansion valves and the outdoor heat exchanger, and the controller controls an opening degree of the outdoor expansion valve such that the temperature of refrigerant in the heating-stopped indoor heat exchanger becomes higher than or equal to an atmosphere temperature of the heating-stopped indoor heat exchanger.

In order to reliably suppress the radiation loss from the heating-stopped indoor heat exchanger, the temperature of refrigerant flowing in the heating-stopped indoor heat exchanger may be made lower than or equal to the atmosphere temperature of the heating-stopped indoor heat exchanger. However, if the temperature of refrigerant flowing in the heating-stopped indoor heat exchanger is much lower than the atmosphere temperature of the heating-stopped indoor heat exchanger, the refrigerant flowing in the heating-stopped indoor heat exchanger may cool the atmosphere of the heating-stopped indoor heat exchanger, which may result in generation of a cold draft from the heating-stopped indoor heat exchanger. In order to prevent the generation of such a cold draft from the heating-stopped indoor heat exchanger, the temperature of refrigerant flowing in the heating-stopped indoor heat exchanger is preferably made higher than or equal to the atmosphere temperature of the heating-stopped indoor heat exchanger. Meanwhile, the temperature of refrigerant flowing in the heating-stopped indoor heat exchanger fluctuates by being influenced by the pressure of refrigerant flowing between the liquid-side indoor expansion valve and the outdoor heat exchanger. Accordingly, for example, in a case where a saturation temperature corresponding to the pressure of refrigerant flowing between the liquid-side indoor expansion valve and the outdoor heat exchanger is much lower than the atmosphere temperature of the heating-stopped indoor heat exchanger, even if the opening degrees of the liquid-side indoor expansion valve and the gas-side indoor expansion valve are controlled in the above manner, it is not possible to make the temperature of refrigerant flowing in the heating-stopped indoor heat exchanger become higher than or equal to the atmosphere temperature of the heating-stopped indoor heat exchanger in some cases.

Therefore, in this case, in a case where both the heating-operation indoor heat exchanger and the heating-stopped indoor heat exchanger are present, the opening degrees of the liquid-side indoor expansion valve and the gas-side indoor expansion valve are controlled, and also the opening degree of the outdoor expansion valve is controlled such that the temperature of refrigerant in the heating-stopped indoor heat exchanger becomes higher than or equal to the atmosphere temperature of the heating-stopped indoor heat exchanger.

Thus, in this case, it is possible to make the temperature of refrigerant flowing in the heating-stopped indoor heat exchanger become higher than or equal to the atmosphere temperature of the heating-stopped indoor heat exchanger so that the radiation loss from the heating-stopped indoor heat exchanger and the cold draft from the heating-stopped indoor heat exchanger can be suppressed. Note that in order to reliably suppress both the radiation loss and the cold draft from the heating-stopped indoor heat exchanger, the opening degree of the outdoor expansion valve is preferably controlled such that the temperature of refrigerant in the heating-stopped indoor heat exchanger becomes equal to the atmosphere temperature of the heating-stopped indoor heat exchanger.

According to an air conditioner according to a seventh aspect, in the air conditioner according to any one of the first to sixth aspects, the controller performs cooling operation in which the refrigerant sealed in the refrigerant circuit is circulated in an order of the compressor, the outdoor heat exchanger, the liquid-side indoor expansion valves, and the indoor heat exchangers and controls opening degrees of the gas-side indoor expansion valves on the basis of an evaporation temperature of refrigerant in the indoor heat exchangers.

During cooling operation under a condition in which the outside air temperature is low and the load is small (low-outside-air-temperature small-load cooling operation), a difference between a high pressure and a low pressure of the compressor may become too small, which results in failure of continuation of the cooling operation.

Therefore, in this case, as described above, during cooling operation, the opening degree of the gas-side indoor expansion valves is controlled on the basis of the evaporation temperature of refrigerant in the indoor heat exchangers.

Thus, in this case, even under an operation condition where the difference between the high pressure and the low pressure of the compressor is likely to be decreased, such as in the low-outside-air-temperature small-load cooling operation, it is possible to perform a stable cooling operation while maintaining a sufficient difference between the high pressure and the low pressure of the compressor.

According to an air conditioner according to an eighth aspect, in the air conditioner according to any one of the first to seventh aspects, the respective indoor heat exchangers are provided in indoor units, and the air conditioner is provided with refrigerant leakage detector. In addition, in this case, if the refrigerant leakage detector detects leakage of the refrigerant, the controller controls the liquid-side indoor expansion valves and the gas-side indoor expansion valves such that opening degrees of the liquid-side indoor expansion valves and the gas-side indoor expansion valves become fully closed. Note that the refrigerant leakage detector may be refrigerant sensors that directly detect leakage of the refrigerant, or may be any device that determines whether the refrigerant has leaked or estimates its amount on the basis of a relationship between the temperature of refrigerant in the indoor heat exchangers and the atmosphere temperature of the indoor heat exchangers, for example.

In this case, as described above, the refrigerant leakage detector is further provided, and, if the refrigerant leakage detector detects leakage of the refrigerant, the liquid-side indoor expansion valves and the gas-side indoor expansion valves are closed. Therefore, it is possible to prevent the refrigerant from flowing into the indoor heat exchangers from the compressor or outdoor heat exchanger side and to suppress an increase in the concentration of refrigerant in indoor spaces.

According to an air conditioner according to a ninth aspect, in the air conditioner according to the eighth aspect, before controlling the liquid-side indoor expansion valves and the gas-side indoor expansion valves to be fully closed, the controller stops the compressor.

In this case, as described above, if the refrigerant leakage detector detects leakage of the refrigerant, before controlling the liquid-side indoor expansion valves and the gas-side indoor expansion valves to be fully closed, the compressor is stopped. Thus, it is possible to suppress an excessive increase in the pressure of refrigerant.

According to an air conditioner according to a tenth aspect, in the air conditioner according to the eight or ninth aspect, the refrigerant circuit further includes pressure adjusting valves that are provided to bypass the respective gas-side indoor expansion valves or the respective liquid-side indoor expansion valves and that open when the pressure of refrigerant in the indoor heat exchangers increases to a predetermined pressure.

In a case where the liquid-side indoor expansion valves and the gas-side indoor expansion valves are fully closed if the refrigerant leakage detector detects leakage of the refrigerant, the indoor heat exchanger in which the refrigerant has not leaked is in a liquid-sealed state, which may result in an excessive increase in the pressure of refrigerant in the indoor heat exchanger.

Accordingly, in this case, as described above, the pressure adjusting valves are provided so as to bypass the gas-side indoor expansion valves or the liquid-side indoor expansion valves. The pressure adjusting valves open when the pressure of refrigerant in the indoor heat exchangers increases to a predetermined pressure. Alternatively, instead of providing the pressure adjusting valves, expansion valves having a function of preventing a liquid-sealed state may be employed as the liquid-side indoor expansion valves or the gas-side indoor expansion valves.

Thus, in this case, it is possible to prevent that the indoor heat exchanger in which the refrigerant has not leaked is in a liquid-sealed state.

DESCRIPTION OF EMBODIMENTS

Hereinafter, an air conditioner according to an embodiment of the present invention will be described with reference to the drawings. Note that a specific configuration of the air conditioner according to the embodiment of the present invention is not limited to the configurations in the following embodiment and modifications thereof and may be changed within the spirit of the present invention.

(1) Configuration

Figure 1:
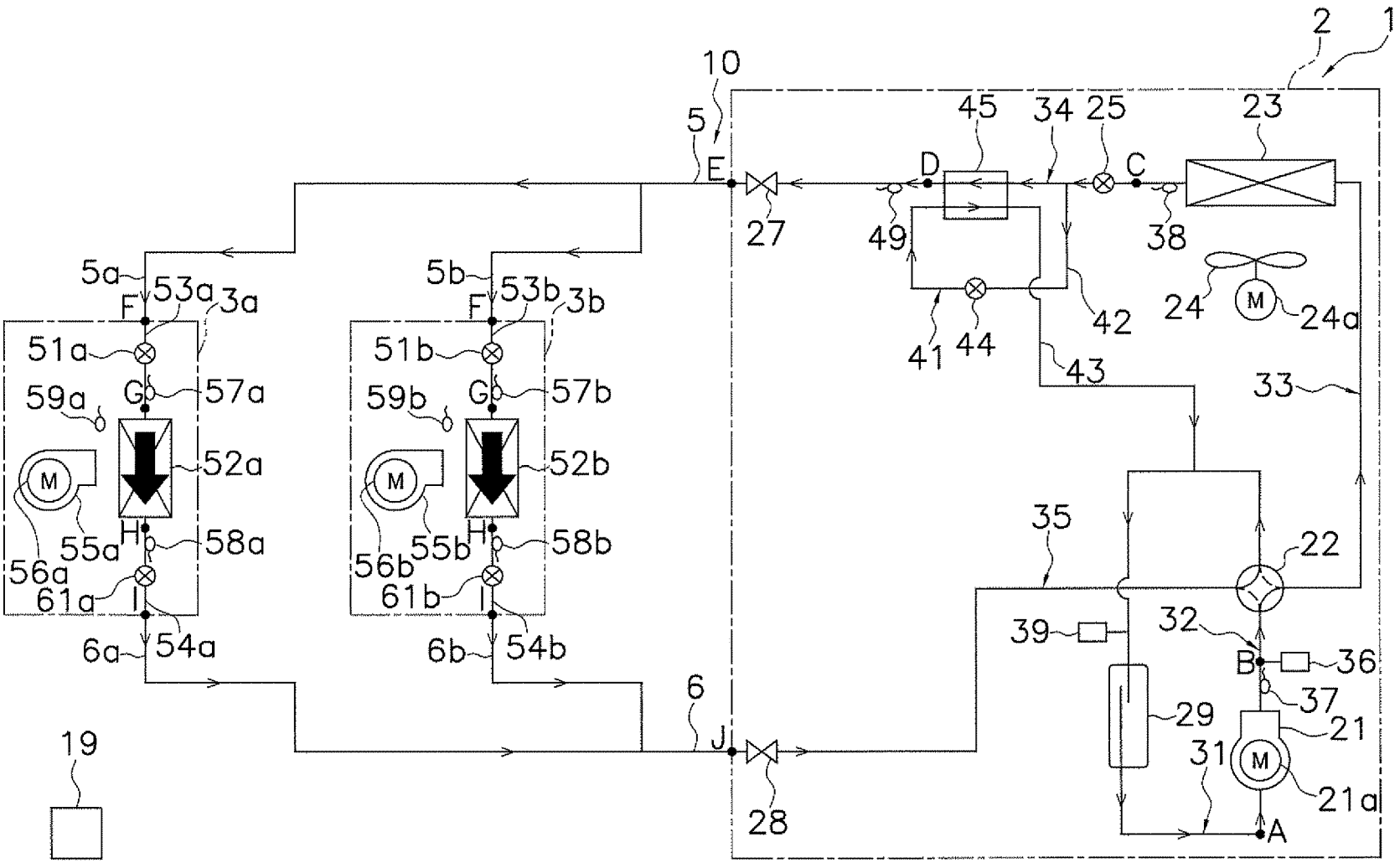
FIG. 1 schematically illustrates a configuration of an air conditioner according to an embodiment of the present invention.

FIG. 1 schematically illustrates a configuration of an air conditioner 1 according to the embodiment of the present invention. The air conditioner 1 is a device that cools or heats indoor spaces of a buildings or the like through a vapor-compression refrigeration cycle. The air conditioner 1 mainly includes an outdoor unit 2, a plurality of (two in this embodiment) indoor units 3*a* and 3*b* that are connected in parallel with each other, a liquid-refrigerant communication pipe 5 and a gas-refrigerant communication pipe 6 that connect the outdoor unit 2 and the indoor units 3*a* and 3*b* to each other, and a control unit 19 that controls components included in the outdoor unit 2 and the indoor units 3*a* and 3*b*. A vapor-compression refrigerant circuit 10 of the air conditioner 1 is constituted by connecting the outdoor unit 2 and the plurality of indoor units 3*a* and 3*b* to each other via the liquid-refrigerant communication pipe 5 and the gas-refrigerant communication pipe 6. The refrigerant circuit 10 is filled with refrigerant, such as R32.

Refrigerant Communication Pipe

The liquid-refrigerant communication pipe 5 mainly includes a junction pipe portion extending from the outdoor unit 2 and a plurality of (two in this embodiment) branch pipe portions 5*a* and 5*b* that branch off at positions in front of the indoor units 3*a* and 3*b*. The gas-refrigerant communication pipe 6 mainly includes a junction pipe portion extending from the outdoor unit 2 and a plurality of (two in this embodiment) branch pipe portions 6*a* and 6*b* that branch off at positions in front of the indoor units 3*a* and 3*b*.

Outdoor Unit

The outdoor unit 2 is installed outside a building or the like. The outdoor unit 2 is connected to the indoor units 3*a* and 3*b* via the liquid-refrigerant communication pipe 5 and the gas-refrigerant communication pipe 6 as described above, and is a part of the refrigerant circuit 10.

Now, a configuration of the outdoor unit 2 will be described.

The outdoor unit 2 mainly includes a compressor 21 and an outdoor heat exchanger 23. The outdoor unit 2 further includes a switching mechanism 22 for switching between a radiator operation state and an evaporator operation state. In the radiator operation state, the outdoor heat exchanger 23 serves as a radiator for refrigerant, whereas in the evaporator operation state, the outdoor heat exchanger 23 serves as an evaporator for refrigerant. The switching mechanism 22 and the suction side of the compressor 21 are connected by a suction refrigerant pipe 31. The suction refrigerant pipe 31 is provided with an accumulator 29 that temporarily accumulates refrigerant that is to be sucked into the compressor 21. The discharge side of the compressor 21 and the switching mechanism 22 are connected by a discharge refrigerant pipe 32. The switching mechanism 22 and the gas-side end of the outdoor heat exchanger 23 are connected by a first outdoor gas-refrigerant pipe 33. The liquid-side end of the outdoor heat exchanger 23 and the liquid-refrigerant communication pipe 5 are connected by an outdoor liquid-refrigerant pipe 34. At a portion of the outdoor liquid-refrigerant pipe 34 where the liquid-refrigerant communication pipe 5 is connected, a liquid-side shutoff valve 27 is provided. The switching mechanism 22 and the gas-refrigerant communication pipe 6 are connected by a second outdoor gas-refrigerant pipe 35. At a portion of the second outdoor gas-refrigerant pipe 35 where the gas-refrigerant communication pipe 6 is connected, a gas-side shutoff valve 28 is provided. The liquid-side shutoff valve 27 and the gas-side shutoff valve 28 are manually opened and closed valves.

The compressor 21 compresses refrigerant and is, for example, a hermetically sealed compressor in which a positive-displacement compression element (not shown), such as a rotary compression element or a scroll compression element, is rotated by a compressor motor 21*a*.

The switching mechanism 22 is, for example, a four-way switching valve and can switch the flow of refrigerant in the refrigerant circuit 10 as follows: the discharge side of the compressor 21 and the gas side of the outdoor heat exchanger 23 are connected (see the solid line in the switching mechanism 22 in FIG. 1) when the outdoor heat exchanger 23 serves as a radiator for refrigerant (hereinafter referred to as "outdoor radiator state"), and the suction side of the compressor 21 and the gas side of the outdoor heat exchanger 23 are connected (see the dashed line in the switching mechanism 22 in FIG. 1) when the outdoor heat exchanger 23 serves as an evaporator for refrigerant (hereinafter referred to as "outdoor evaporator state").

The outdoor heat exchanger 23 is a heat exchanger that serves as a radiator for refrigerant or an evaporator for refrigerant. Note that the outdoor unit 2 includes an outdoor fan 24 for sucking outdoor air into the outdoor unit 2 and discharging, to the outside, the air that has been subjected to heat exchange with refrigerant in the outdoor heat exchanger 23. That is, the outdoor unit 2 includes the outdoor fan 24 as a fan that supplies the outdoor heat exchanger 23 with outdoor air as a cooling source or a heating source for refrigerant flowing in the outdoor heat exchanger 23. In this embodiment, the outdoor fan 24 is driven by an outdoor fan motor 24*a*.

In addition, in this embodiment, the outdoor liquid-refrigerant pipe 34 is provided with an outdoor expansion valve 25. The outdoor expansion valve 25 is an electric expansion valve that decompresses refrigerant during heating operation and is provided in a portion of the outdoor liquid-refrigerant pipe 34 that is close to the liquid-side end of the outdoor heat exchanger 23.

Furthermore, in this embodiment, the outdoor liquid-refrigerant pipe 34 is connected to a refrigerant returning pipe 41, and a refrigerant cooler 45 is provided. The refrigerant returning pipe 41 is a refrigerant pipe that branches a part of refrigerant flowing in the outdoor liquid-refrigerant pipe 34 to send it to the compressor 21. The refrigerant cooler 45 is a heat exchanger that cools the refrigerant flowing in the outdoor liquid-refrigerant pipe 34 by using refrigerant flowing in the refrigerant returning pipe 41. Note that the outdoor expansion valve 25 is provided at a portion of the outdoor liquid-refrigerant pipe 34 that is closer to the outdoor heat exchanger 23 than to the refrigerant cooler 45.

The refrigerant returning pipe 41 is a refrigerant pipe that sends refrigerant that is branched off from the outdoor liquid-refrigerant pipe 34 to the suction side of the compressor 21. The refrigerant returning pipe 41 mainly includes a refrigerant returning inlet pipe 42 and a refrigerant returning outlet pipe 43. The refrigerant returning inlet pipe 42 is a refrigerant pipe that branches a part of the refrigerant flowing in the outdoor liquid-refrigerant pipe 34 from a portion between the liquid-side end of the outdoor heat exchanger 23 and the liquid-side shutoff valve 27 (a portion between the outdoor expansion valve 25 and the refrigerant cooler 45 in this embodiment) to send it to the inlet of the refrigerant cooler 45 on the refrigerant returning pipe 41 side. The refrigerant returning inlet pipe 42 is provided with a refrigerant returning expansion valve 44 that adjusts the flow rate of refrigerant flowing in the refrigerant cooler 45 while decompressing the refrigerant flowing in the refrigerant returning pipe 41. Note that the refrigerant returning expansion valve 44 is an electric expansion valve. The refrigerant returning outlet pipe 43 is a refrigerant pipe that sends refrigerant from the outlet of the refrigerant cooler 45 on the refrigerant returning pipe 41 side to the suction refrigerant pipe 31. Moreover, the refrigerant returning outlet pipe 43 of the refrigerant returning pipe 41 is connected to a portion of the suction refrigerant pipe 31 on the inlet side of the accumulator 29. In addition, the refrigerant cooler 45 cools the refrigerant flowing in the outdoor liquid-refrigerant pipe 34 by using the refrigerant flowing in the refrigerant returning pipe 41.

The outdoor unit 2 is provided with various sensors. Specifically, the outdoor unit 2 is provided with a discharge pressure sensor 36, a discharge temperature sensor 37, and a suction pressure sensor 39. The discharge pressure sensor 36 detects a pressure (discharge pressure Pd) of refrigerant discharged from the compressor 21. The discharge temperature sensor 37 detects a temperature (discharge temperature Td) of refrigerant discharged from the compressor 21. The suction pressure sensor 39 detects a pressure (suction pressure Ps) of refrigerant that is to be sucked into the compressor 21. The outdoor unit 2 is further provided with an outdoor heat exchanger liquid-side sensor 38 and a liquid pipe temperature sensor 49. The outdoor heat exchanger liquid-side sensor 38 detects a temperature Tol (outdoor heat exchanger outlet temperature Tol) of refrigerant at the liquid-side end of the outdoor heat exchanger 23. The liquid pipe temperature sensor 49 detects a temperature (liquid pipe temperature Tlp) of refrigerant at a portion of the outdoor liquid-refrigerant pipe 34 between the refrigerant cooler 45 and the liquid-side shutoff valve 27.

Indoor Unit

The indoor units 3*a* and 3*b* are installed in indoor spaces of a building or the like. The indoor units 3*a* and 3*b* are connected to the outdoor unit 2 via the liquid-refrigerant communication pipe 5 and the gas-refrigerant communication pipe 6 as described above, and are parts of the refrigerant circuit 10.

Now, configurations of the indoor units 3*a* and 3*b* will be described. Since the indoor unit 3*a* and the indoor unit 3*b* have substantially the same configuration, only the configuration of the indoor unit 3*a* will be described in this embodiment. Description of components of the indoor unit 3*b* will be omitted by denoting the components with subscript "b" instead of subscript "a", which denotes components of the indoor unit 3*a*.

The indoor unit 3*a* mainly includes a liquid-side indoor expansion valve 51*a* and an indoor heat exchanger 52*a*. The indoor unit 3*a* further includes an indoor liquid-refrigerant pipe 53*a* and an indoor gas-refrigerant pipe 54*a*. The indoor liquid-refrigerant pipe 53*a* connects the liquid-side end of the indoor heat exchanger 52*a* and the liquid-refrigerant communication pipe 5. The indoor gas-refrigerant pipe 54*a* connects the gas-side end of the indoor heat exchanger 52*a* and the gas-refrigerant communication pipe 6.

The liquid-side indoor expansion valve 51*a* is an electric expansion valve provided to correspond to the liquid side of the indoor heat exchanger 52*a* and is provided in the indoor liquid-refrigerant pipe 53*a*.

The indoor heat exchanger 52*a* is a heat exchanger that serves as an evaporator for refrigerant to cool indoor air or as a radiator for refrigerant to heat indoor air. Note that the indoor unit 3*a* includes an indoor fan 55*a* that sucks indoor air into the indoor unit 3*a* and supplies indoor spaces with, as supplied air, the air that has been subjected to heat exchange with refrigerant in the indoor heat exchanger 52*a*. That is, the indoor unit 3*a* includes the indoor fan 55*a* as a fan that supplies the indoor heat exchanger 52*a* with indoor air as a cooling source or a heating source for refrigerant flowing in the indoor heat exchanger 52*a*. The indoor fan 55*a* is driven by an indoor fan motor 56*a*.

Focusing only on the compressor 21, the outdoor heat exchanger 23, the liquid-side indoor expansion valves 51*a* and 51*b*, and the indoor heat exchangers 52*a* and 52*b* in the air conditioner 1, cooling operation is performed in which refrigerant sealed in the refrigerant circuit 10 is circulated in the order of the compressor 21, the outdoor heat exchanger 23, the liquid-refrigerant communication pipe 5, the liquid-side indoor expansion valves 51*a* and 51*b*, the indoor heat exchangers 52*a* and 52*b*, the gas-refrigerant communication pipe 6, and the compressor 21. In addition, focusing only on the compressor 21, the outdoor heat exchanger 23, the liquid-side indoor expansion valves 51*a* and 51*b*, and the indoor heat exchangers 52*a* and 52*b* in the air conditioner 1, heating operation is performed in which the refrigerant sealed in the refrigerant circuit 10 is circulated in the order of the compressor 21, the indoor heat exchangers 52*a* and 52*b*, the liquid-side indoor expansion valves 51*a* and 51*b*, and the outdoor heat exchanger 23. Note that in this embodiment, the switching mechanism 22 is switched to the outdoor radiator state during cooling operation and to the outdoor evaporator state during heating operation.

Furthermore, in this embodiment, a gas-side indoor expansion valve 61*a* corresponding to the gas side of the indoor heat exchanger 52*a* is further provided. The gas-side indoor expansion valve 61*a* is an electric expansion valve provided in the indoor gas-refrigerant pipe 54*a*.

The indoor unit 3*a* is provided with various sensors. Specifically, the indoor unit 3*a* is provided with an indoor heat exchanger liquid-side sensor 57*a*, an indoor heat exchanger gas-side sensor 58*a*, and an indoor air sensor 59*a*. The indoor heat exchanger liquid-side sensor 57*a* detects a temperature Trl of refrigerant at the liquid-side end of the indoor heat exchanger 52*a*. The indoor heat exchanger gas-side sensor 58*a* detects a temperature Trg of refrigerant at the gas-side end of the indoor heat exchanger 52*a*. The indoor air sensor 59*a* detects a temperature Tra of indoor air that is to be sucked into the indoor unit 3*a*.

Control Unit

The control unit 19 is constituted by a control board and the like (not shown) provided in the outdoor unit 2, the indoor units 3*a* and 3*b*, and the like connected to each other via communication lines. Note that the control unit 19 is illustrated at a position away from the outdoor unit 2 and the indoor units 3*a* and 3*b* for convenience in FIG. 1. On the basis of detection signals and the like from the various sensors 36, 37, 38, 39, 49, 57*a*, 57*b*, 58*a*, 58*b*, 59*a*, and 59*b* described above, the control unit 19 controls the components 21, 22, 24, 25, 44, 51*a*, 51*b*, 55*a*, 55*b*, 61*a*, and 61*b* of the air conditioner 1 (the outdoor unit 2 and the indoor units 3*a* and 3*b* in this embodiment). That is, the control unit 19 controls operations of the entire air conditioner 1.

(2) Operations and Features of Air Conditioner

Next, the operations and features of the air conditioner 1 will be described with reference to FIGS. 1 to 6.

The air conditioner 1 performs cooling operation and heating operation. Note that the operations of the air conditioner 1 described below are performed by the control unit 19 that controls the components of the air conditioner 1.

Cooling Operation

During cooling operation, for example, when all the indoor units 3*a* and 3*b* perform cooling operation (i.e., operation in which all the indoor heat exchangers 52*a* and 52*b* serve as evaporators for refrigerant and in which the outdoor heat exchanger 23 serves as a radiator for refrigerant), the switching mechanism 22 is switched to the outdoor radiator state (state illustrated by the solid line in the switching mechanism 22 in FIG. 1), and the compressor 21, the outdoor fan 24, and the indoor fans 55*a* and 55*b* are driven.

Subsequently, high-pressure refrigerant discharged from the compressor 21 is sent through the switching mechanism 22 to the outdoor heat exchanger 23 (see point B in FIGS. 1 and 2). In the outdoor heat exchanger 23 serving as a radiator for refrigerant, the refrigerant sent to the outdoor heat exchanger 23 is subjected to heat exchange with outdoor air that is supplied by the outdoor fan 24, to be cooled and condensed (see point C in FIGS. 1 and 2). The refrigerant flows through the outdoor expansion valve 25, the refrigerant cooler 45, and the liquid-side shutoff valve 27 to flow out of the outdoor unit 2 (see point E in FIGS. 1 and 2).

Figure 2:
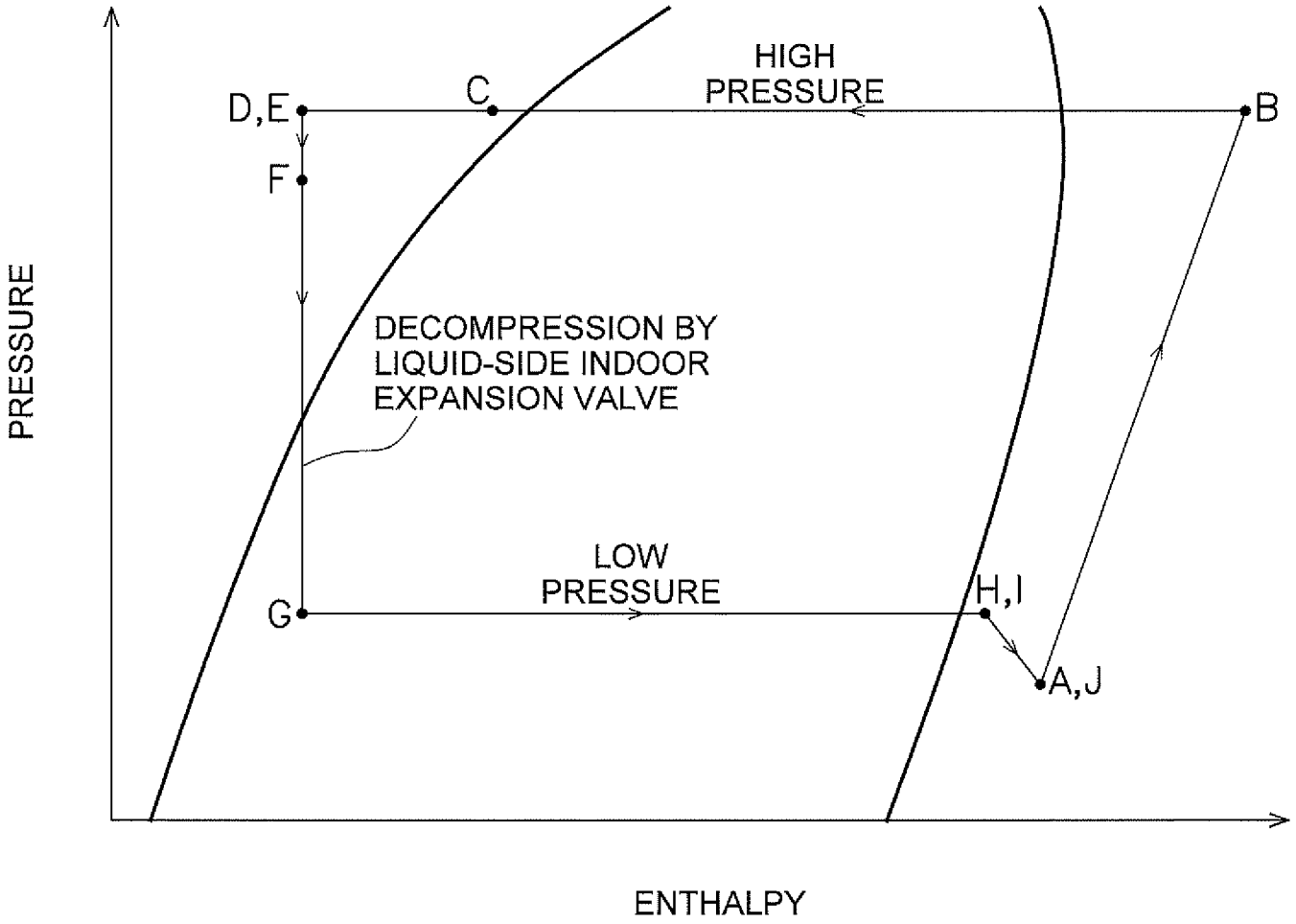
FIG. 2 is a pressure-enthalpy diagram illustrating a refrigeration cycle during cooling operation of the air conditioner according to the embodiment of the present invention.

The refrigerant that flows out of the outdoor unit 2 branches into and sent to the indoor units 3*a* and 3*b* through the liquid-refrigerant communication pipe 5 (see points F in FIGS. 1 and 2). The refrigerant sent to the indoor units 3*a* and 3*b* is decompressed by the liquid-side indoor expansion valves 51*a* and 51*b* to a low pressure to be sent to the indoor heat exchangers 52*a* and 52*b* (see points G in FIGS. 1 and 2). In the indoor heat exchangers 52*a* and 52*b* serving as evaporators for refrigerant, the refrigerant sent to the indoor heat exchangers 52*a* and 52*b* is subjected to heat exchange with indoor air that is supplied from indoor spaces by the indoor fans 55*a* and 55*b*, to be heated and evaporated (see points H in FIGS. 1 and 2). The refrigerant flows through the gas-side indoor expansion valves 61*a* and 61*b* to flow out of the indoor units 3*a* and 3*b* (see points I in FIGS. 1 and 2).

On the other hand, indoor air that is cooled in the indoor heat exchangers 52*a* and 52*b* is sent to indoor spaces, and thereby indoor spaces are cooled.

The refrigerant that flows out of the indoor units 3*a* and 3*b* is sent together to the outdoor unit 2 through the gas-refrigerant communication pipe 6 (see point J in FIGS. 1 and 2). The refrigerant sent to the outdoor unit 2 is sent through the gas-side shutoff valve 28, the switching mechanism 22, and the accumulator 29 to be sucked into the compressor 21 (see point A in FIGS. 1 and 2).

During cooling operation described above, the control unit 19 causes the refrigerant flowing in the outdoor liquid-refrigerant pipe 34 to be cooled by using the refrigerant returning pipe 41 and the refrigerant cooler 45 to be sent to the liquid-refrigerant communication pipe 5. Specifically, the control unit 19 controls the opening degree of the refrigerant returning expansion valve 44 so as to regulate the flow rate of refrigerant flowing in the refrigerant returning pipe 41. In this embodiment, the control unit 19 causes the liquid-side indoor expansion valves 51*a* and 51*b* to decompress the refrigerant sent from the liquid-refrigerant communication pipe 5 to the indoor units 3*a* and 3*b* until the refrigerant is in a low-pressure gas-liquid two-phase state. Specifically, the control unit 19 controls the opening degrees of the liquid-side indoor expansion valves 51*a* and 51*b* such that a degree of superheating SHr of refrigerant at the gas-side ends of the indoor heat exchangers 52*a* and 52*b* becomes a target degree of superheating SHrt. The control unit 19 obtains the degree of superheating SHr of refrigerant at the gas-side ends of the indoor heat exchangers 52*a* and 52*b* by subtracting the indoor heat exchanger liquid-side temperature Trl from the indoor heat exchanger gas-side temperature Trg. The control unit 19 controls the opening degrees of the liquid-side indoor expansion valves 51*a* and 51*b* as follows: the opening degrees of the liquid-side indoor expansion valves 51*a* and 51*b* are increased when the degree of superheating SHr is larger than the target degree of superheating SHrt; and the opening degrees of the liquid-side indoor expansion valves 51*a* and 51*b* are decreased when the degree of superheating SHr is smaller than the target degree of superheating SHrt. Additionally, in this embodiment, the control unit 19 controls the opening degrees of the gas-side indoor expansion valves 61*a* and 61*b* to be fixed in a full-open state so that the refrigerant that flows out of the indoor heat exchangers 52*a* and 52*b* is not decompressed. Furthermore, in this embodiment, the control unit 19 also controls the opening degree of the outdoor expansion valve 25 to be fixed in a full-open state so that the refrigerant that flows out of the outdoor heat exchanger 23 is not decompressed.

Heating Operation

Case where all Indoor Units Perform Heating Operation

Figure 3:
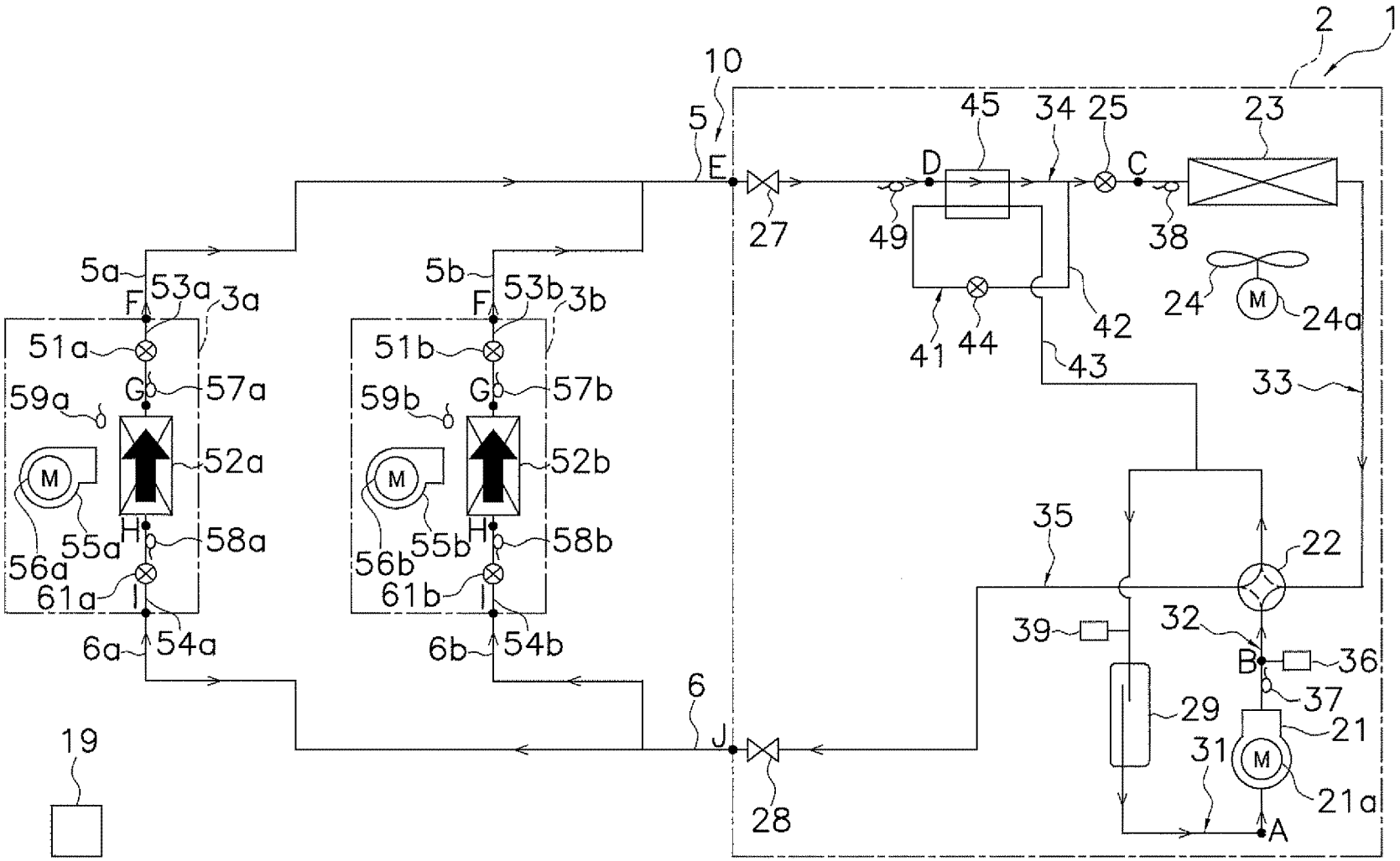
FIG. 3 illustrates flow of refrigerant in a case where all indoor units of the air conditioner according to the embodiment of the present invention perform heating operation.

In a case where all the indoor units 3*a* and 3*b* perform heating operation (i.e., operation in which all the indoor heat exchangers 52*a* and 52*b* serve as radiators for refrigerant and in which the outdoor heat exchanger 23 serves as an evaporator for refrigerant), the switching mechanism 22 is switched to the outdoor evaporator state (state illustrated by the dashed line in the switching mechanism 22 in FIG. 3), and the compressor 21, the outdoor fan 24, and the indoor fans 55*a* and 55*b* are driven.

Subsequently, the high-pressure refrigerant discharged from the compressor 21 is sent through the switching mechanism 22 and the gas-side shutoff valve 28 to flow out of the outdoor unit 2 (see point J in FIGS. 3 and 4).

Figure 4:
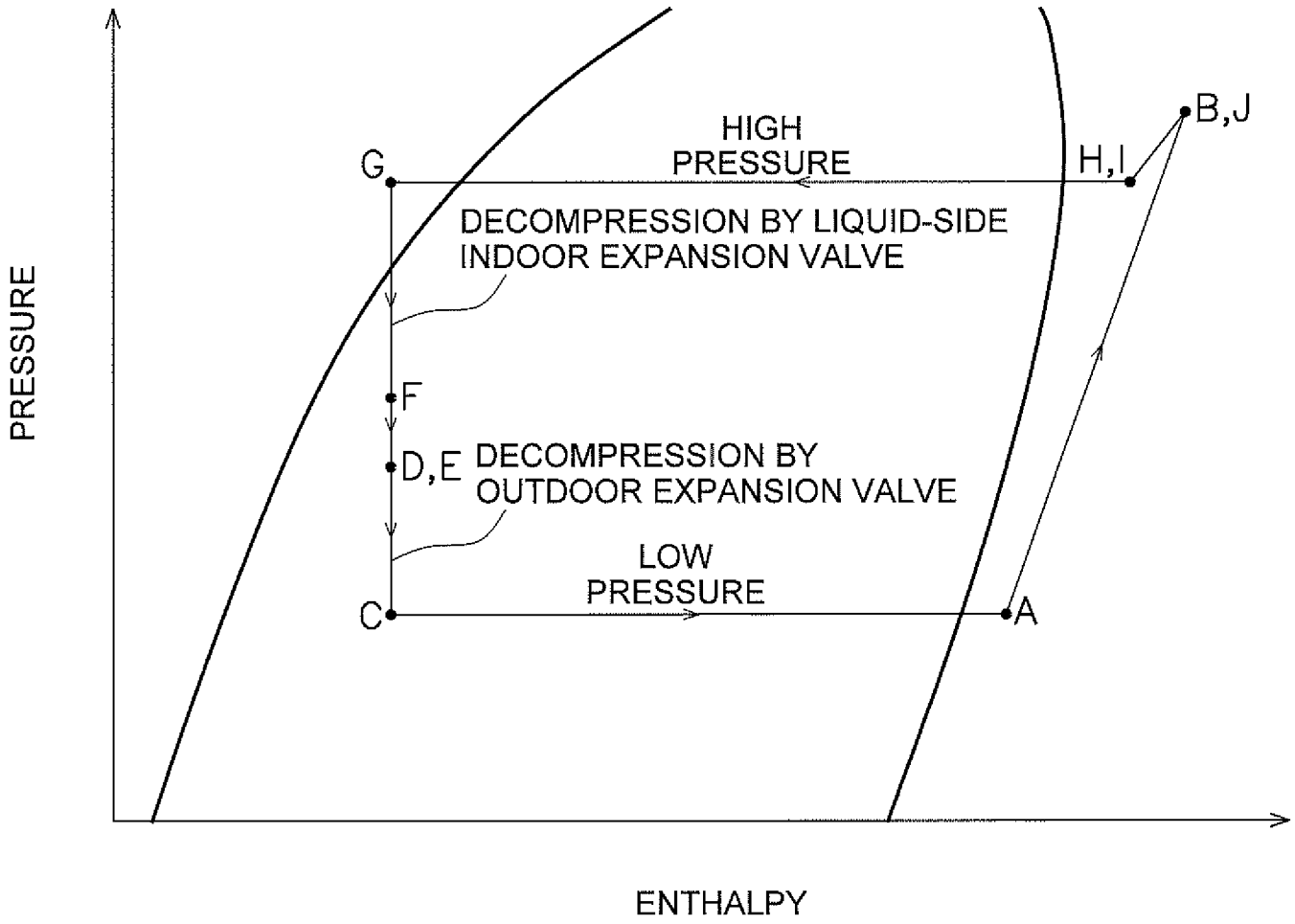
FIG. 4 is a pressure-enthalpy diagram illustrating a refrigeration cycle in a case where all indoor units of the air conditioner according to the embodiment of the present invention perform heating operation.

The refrigerant that flows out of the outdoor unit 2 branches into and sent to the indoor units 3*a* and 3*b* through the gas-refrigerant communication pipe 6 (see points I in FIGS. 3 and 4). The refrigerant sent to the indoor units 3*a* and 3*b* is sent through the gas-side indoor expansion valves 61*a* and 61*b* to the indoor heat exchangers 52*a* and 52*b* (see points H in FIGS. 3 and 4). In the indoor heat exchangers 52*a* and 52*b* serving as radiators for refrigerant, the high-pressure refrigerant sent to the indoor heat exchangers 52*a* and 52*b* is subjected to heat exchange with indoor air supplied from indoor spaces by the indoor fans 55*a* and 55*b*, to be cooled and condensed (points G in FIGS. 3 and 4). The refrigerant is decompressed by the indoor expansion valves 51*a* and 51*b* to flow out of the indoor units 3*a* and 3*b* (see points F in FIGS. 3 and 4). On the other hand, indoor air that is heated in the indoor heat exchangers 52*a* and 52*b* is sent to indoor spaces, and thereby indoor spaces are heated.

The refrigerant that flows out of the indoor units 3*a* and 3*b* is sent together to the outdoor unit 2 through the liquid-refrigerant communication pipe 5 (see point E in FIGS. 3 and 4). The refrigerant sent to the outdoor unit 2 is sent through the liquid-side shutoff valve 27 and the refrigerant cooler 45 to the outdoor expansion valve 25 (see point D in FIGS. 3 and 4). The refrigerant sent to the outdoor expansion valve 25 is decompressed by the outdoor expansion valve 25 to a low pressure and is then sent to the outdoor heat exchanger 23 (see point C in FIGS. 3 and 4). The refrigerant sent to the outdoor heat exchanger 23 is subjected to heat exchange with outdoor air that is supplied by the outdoor fan 24 to be heated and evaporated. The refrigerant is sent through the switching mechanism 22 and the accumulator 29 to be sucked into the compressor 21 (see point A in FIGS. 3 and 4).

In a case where all the indoor units 3*a* and 3*b* described above perform heating operation, the control unit 19 causes the liquid-side indoor expansion valves 51*a* and 51*b* to decompress the refrigerant that has released heat in the indoor heat exchangers 52*a* and 52*b*. Specifically, the control unit 19 controls the opening degrees of the liquid-side indoor expansion valves 51*a* and 51*b* such that a degree of subcooling SCr of refrigerant at the liquid-side ends of the indoor heat exchangers 52*a* and 52*b* becomes a target degree of subcooling SCrt. Specifically, the control unit 19 obtains the degree of subcooling SCr of refrigerant at the liquid-side ends of the indoor heat exchangers 52*a* and 52*b* from the indoor heat exchanger liquid-side temperature Trl. The control unit 19 obtains the degree of subcooling SCr of refrigerant at the liquid-side ends of the indoor heat exchangers 52*a* and 52*b* by subtracting the indoor heat exchanger liquid-side temperature Trl from a temperature Trc of refrigerant obtained by converting the discharge pressure Pd into a saturation temperature. The control unit 19 controls the opening degrees of the liquid-side indoor expansion valves 51*a* and 51*b* as follows: the opening degrees of the liquid-side indoor expansion valves 51*a* and 51*b* are decreased when the degree of subcooling SCr is smaller than the target degree of subcooling SCrt; and the opening degrees of the liquid-side indoor expansion valves 51*a* and 51*b* are increased when the degree of subcooling SCr is larger than the target degree of subcooling SCrt. Additionally, in this embodiment, the control unit 19 controls the opening degrees of the gas-side indoor expansion valves 61*a* and 61*b* to be fixed in a full-open state so that the refrigerant that flows into the indoor heat exchangers 52*a* and 52*b* is not decompressed. Furthermore, in this embodiment, the control unit 19 also controls the outdoor expansion valve 25 so that the refrigerant flowing in the outdoor liquid-refrigerant pipe 34 is in a low-pressure gas-liquid two-phase state to be sent to the outdoor heat exchanger 23. Specifically, the control unit 19 controls the opening degree of the outdoor expansion valve 25 to adjust the decompression degree of refrigerant that is to be sent to the outdoor heat exchanger 23. In addition, in this embodiment, the control unit 19 sets the opening degree of the refrigerant returning expansion valve 44 to a full-closed state to prevent the refrigerant from flowing into the refrigerant returning pipe 41.

Case where Some of Indoor Unit does not Perform Heating Operation

In some cases of heating operation, some of the indoor heat exchangers 52*a* and 52*b* serves as a heating-operation indoor heat exchanger, which performs heating operation, while the remain of the indoor heat exchangers 52*a* and 52*b* serves as a heating-stopped indoor heat exchanger, which does not perform heating operation. The phrase "not perform heating operation" herein means a state in which the operation of an indoor unit including an indoor heat exchanger is stopped or a state in which the indoor unit is in a thermo-off state, and the term "heating-stopped indoor heat exchanger" means the indoor heat exchanger of the indoor unit in this "not perform heating operation" state.

In a case where both the heating-operation indoor heat exchanger and the heating-stopped indoor heat exchanger are present in this manner, refrigerant may be accumulated in the heating-stopped indoor heat exchanger. As measures against this situation, in the related art, for example, a liquid-side indoor expansion valve corresponding to the heating-stopped indoor heat exchanger is controlled to be slightly open so that a small amount of refrigerant flows into the heating-stopped indoor heat exchanger, or an expansion mechanism (formed by using a capillary tube and a check valve) that bypasses the liquid-side indoor expansion valve is provided so that a small amount of refrigerant flows into the heating-stopped indoor heat exchanger through the expansion mechanism in a state where the liquid-side indoor expansion valve is closed.

However, when a small amount of refrigerant flows into the heating-stopped indoor heat exchanger (which is, for example, the indoor heat exchanger 52*b*) by controlling the liquid-side indoor expansion valve to be slightly open or using the expansion mechanism that bypasses the liquid-side indoor expansion valve as in the related art, the refrigerant is not decompressed on the upstream side of the heating-stopped indoor heat exchanger 52*b*, and the refrigerant is decompressed to a great extent on the downstream side of the heating-stopped indoor heat exchanger 52*b* (see points G and F in FIG. 4). Thus, as in the heating-operation indoor heat exchanger (which is, for example, the indoor heat exchanger 52*a*), the high-pressure refrigerant discharged from the compressor 21 also flows also into the heating-stopped indoor heat exchanger 52*b* (see point G in FIG. 4). Furthermore, the high-pressure refrigerant discharged from the compressor 21 has a much higher temperature than an atmosphere temperature (which is, for example, the indoor temperature Tra) of the heating-stopped indoor heat exchanger 52*b*, which has led to generation of a radiation loss from the heating-stopped indoor heat exchanger 52*b*.

Figure 5:
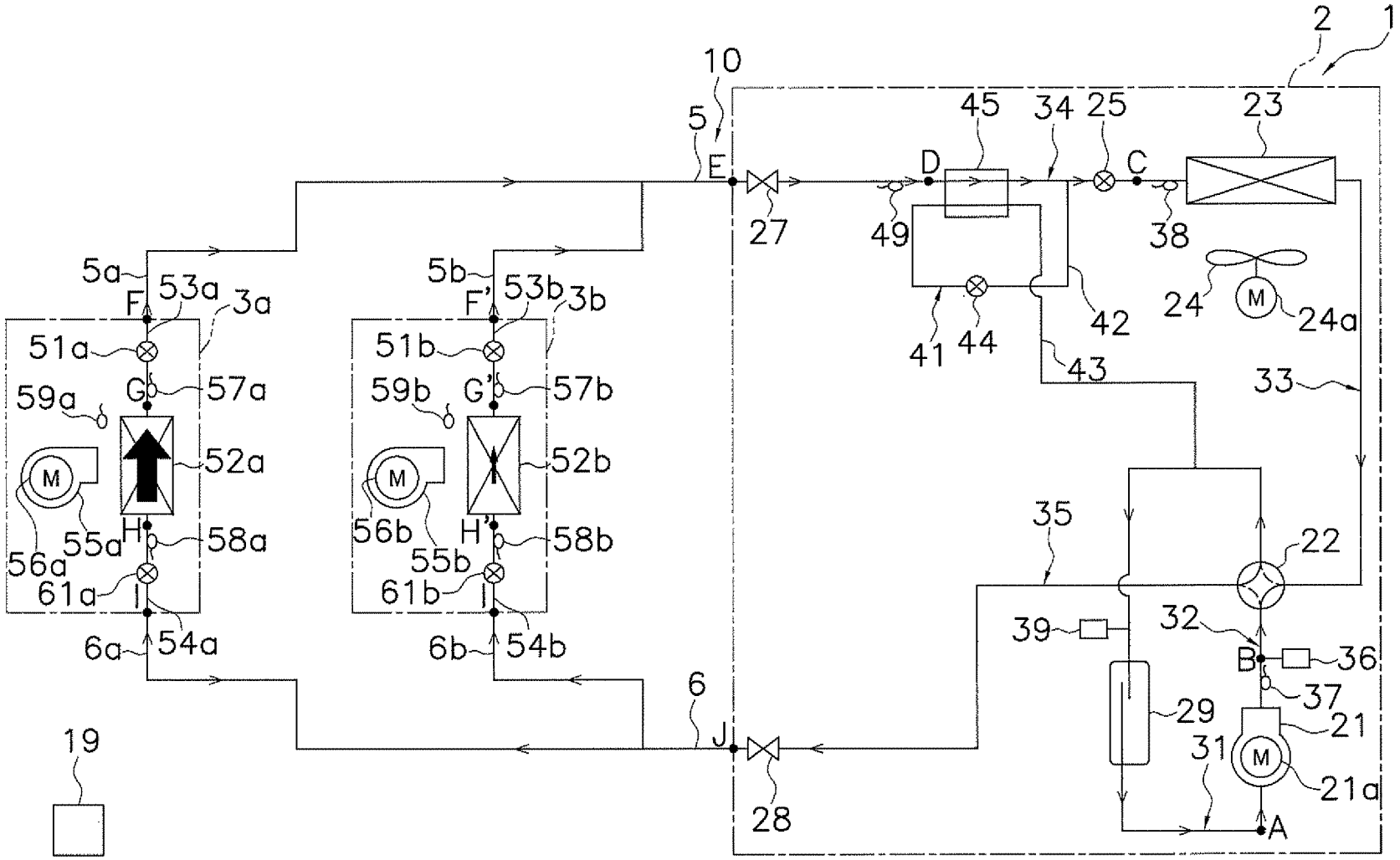
FIG. 5 illustrates flow of refrigerant during heating operation in a case where both a heating-operation indoor heat exchanger and a heating-stopped indoor heat exchanger are present in an air conditioner according to the embodiment, a first modification, and a second modification of the present invention.

Therefore, in this embodiment, the gas-side indoor expansion valves 61*a* and 61*b* are provided at the gas side of the indoor heat exchangers 52*a* and 52*b* as described above. In a case where both the heating-operation indoor heat exchanger 52*a* and the heating-stopped indoor heat exchanger 52*b* are present, as illustrated in FIGS. 5 and 6, the control unit 19 controls the liquid-side indoor expansion valve 51*b* and the gas-side indoor expansion valve 61*b* corresponding to the heating-stopped indoor heat exchanger 52*b* such that the opening degree of the gas-side indoor expansion valve 61*b* becomes smaller than the opening degree of the liquid-side indoor expansion valve 51*b*.

Specifically, in this embodiment, the control unit 19 controls the gas-side indoor expansion valve 61*b* corresponding to the heating-stopped indoor heat exchanger 52*b* such that the opening degree thereof becomes slightly open. The term "slightly-open" herein corresponds to an opening degree of about 15% or less when a fully open state of the gas-side indoor expansion valves 61*a* and 61*b* is 100%. In addition, in this embodiment, the control unit 19 controls the liquid-side indoor expansion valve 51*b* corresponding to the heating-stopped indoor heat exchanger 52*b* such that the opening degree thereof becomes fully open.

Figure 6:
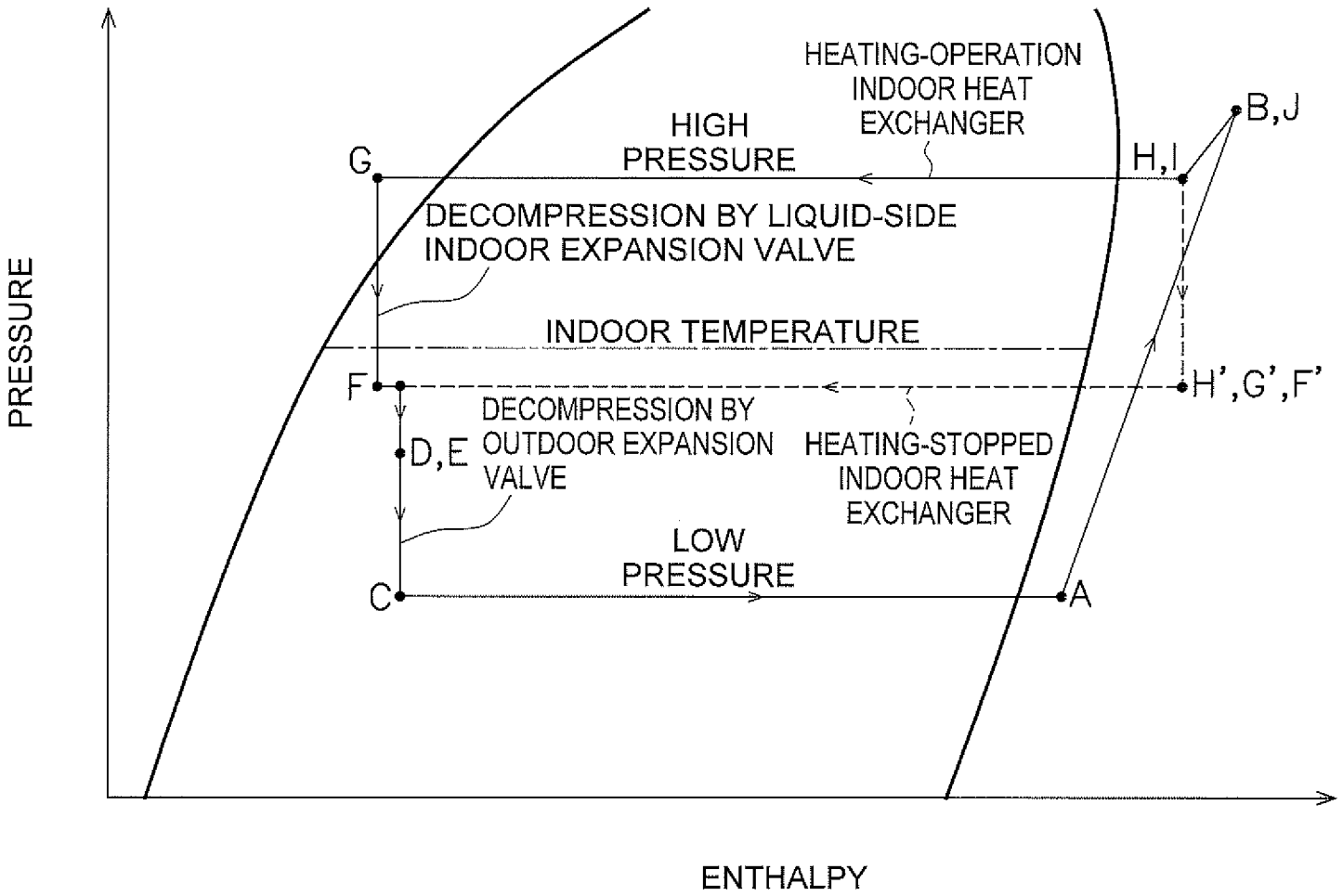
FIG. 6 is a pressure-enthalpy diagram illustrating a refrigeration cycle during heating operation in a case where both the heating-operation indoor heat exchanger and the heating-stopped indoor heat exchanger are present in the air conditioner according to the embodiment and the first modification of the present invention.

When the liquid-side indoor expansion valve 51*b* and the gas-side indoor expansion valve 61*b* are controlled in the above manner, the refrigerant is decompressed to a great extent on the upstream side of the heating-stopped indoor heat exchanger 52*b* compared with that on the downstream side of the heating-stopped indoor heat exchanger 52*b* (see points I and H' in FIG. 6). Thus, a small amount of refrigerant at a low pressure, compared with the high-pressure refrigerant discharged from the compressor 21, flows into the heating-stopped indoor heat exchanger 52*b* (see the arrow on the indoor heat exchanger 52*b* in FIG. 5 and points H' and G' in FIG. 6). Accordingly, in this embodiment, the temperature of refrigerant flowing in the heating-stopped indoor heat exchanger 52*b* can be decreased to approach the atmosphere temperature (the indoor temperature Tra in this embodiment) of the heating-stopped indoor heat exchanger 52*b*. As a result, the radiation loss from the heating-stopped indoor heat exchanger 52*b* can be suppressed. Note that the radiation loss from the heating-stopped indoor heat exchanger 52*b* can alternatively be suppressed by fully closing the gas-side indoor expansion valve 61*b*. This case, however, is not preferred because the high-pressure refrigerant discharged from the compressor 21 may be accumulated in a gas-refrigerant pipe (the indoor gas-refrigerant pipe 54*a* and a branch pipe portion 6*b* of the gas-refrigerant communication pipe 6 in this embodiment) to which the heating-stopped indoor heat exchanger 52*b* is connected.

In the above manner, in this embodiment, in order to suppress accumulation of refrigerant, in a case where both the heating-operation indoor heat exchanger 52*a* and the heating-stopped indoor heat exchanger 52*b* are present, by causing a small amount of refrigerant to flow into the heating-stopped indoor heat exchanger 52*b*, the gas-side indoor expansion valves 61*a* and 61*b* are provided and controlled such that the opening degree of the gas-side indoor expansion valve 61*b* becomes smaller than the opening degree of the liquid-side indoor expansion valve 51*b*. As a result, the radiation loss from the heating-stopped indoor heat exchanger 52*b* can be suppressed.

In particular, as described above, the gas-side indoor expansion valve 61*b* corresponding to the heating-stopped indoor heat exchanger 52*b* is controlled such that the opening degree thereof becomes slightly open in this embodiment. Thus, a small amount of refrigerant is decompressed to a great extent on the upstream side of the heating-stopped indoor heat exchanger 52*b*, and a small amount of refrigerant at a sufficiently low pressure, compared with the high-pressure refrigerant discharged from the compressor 21, flows into the heating-stopped indoor heat exchanger 52*b* (see points H' and G' in FIG. 6). In addition, as described above, the liquid-side indoor expansion valve 51*b* corresponding to the heating-stopped indoor heat exchanger 52*b* is controlled such that the opening degree thereof becomes fully open in this embodiment. Thus, refrigerant at the same pressure as the refrigerant that has been decompressed by the liquid-side indoor expansion valve 51*a* corresponding to the heating-operation indoor heat exchanger 52*a* flows into the heating-stopped indoor heat exchanger 52*b* (see points F and F' in FIG. 6).

Accordingly, in this embodiment, the temperature of refrigerant flowing in the heating-stopped indoor heat exchanger 52*b* can further approach the atmosphere temperature Tra of the heating-stopped indoor heat exchanger 52*b*, and the radiation loss from the heating-stopped indoor heat exchanger 52*b* can be sufficiently suppressed.

As described above, the opening degree of the gas-side indoor expansion valve 61*b* is made smaller than the opening degree of the liquid-side indoor expansion valve 51*b* by fully opening the liquid-side indoor expansion valve 51*b* corresponding to the heating-stopped indoor heat exchanger 52*b* and slightly opening the gas-side indoor expansion valve 61*a* in this embodiment. However, any other combination of opening degrees may be employed.

While the liquid-side indoor expansion valve 51*b* and the gas-side indoor expansion valve 61*b* corresponding to the heating-stopped indoor heat exchanger 52*b* are controlled in the above manner, the gas-side indoor expansion valve 61*a* corresponding to the heating-operation indoor heat exchanger 52*a* is controlled such that the opening degree thereof becomes fully open, as in a case where all the indoor units 3*a* and 3*b* perform heating operation (see FIGS. 3 and 4). As for the liquid-side indoor expansion valve 51*a* corresponding to the heating-operation indoor heat exchanger 52*a*, the opening degree of the liquid-side indoor expansion valve 51*a* is controlled such that the degree of subcooling SCr of refrigerant at the liquid-side end of the heating-operation indoor heat exchanger 52*a* becomes the target degree of subcooling SCrt, as in a case where all the indoor units 3*a* and 3*b* perform heating operation (see FIGS. 3 and 4).

Thus, in this case, unlike in the heating-stopped indoor heat exchanger 52*b*, the high-pressure refrigerant discharged from the compressor 21 can directly flow into the heating-operation indoor heat exchanger 52*a* (see points I and H in FIG. 6). Accordingly, in this case, as for the heating-operation indoor heat exchanger 52*a*, it is possible to perform heating operation as in a case where all the indoor heat exchangers 52*a* and 52*b* perform heating operation and in a case of a configuration of the related art in which the gas-side indoor expansion valves 51 are not provided.

(3) First Modification

In order to reliably suppress the radiation loss from the heating-stopped indoor heat exchanger 52*b* in the control where some of the indoor units does not perform heating operation in the above embodiment (see FIGS. 5 and 6), the temperature of refrigerant flowing in the heating-stopped indoor heat exchanger 52*b* (the temperature Trl of refrigerant at the liquid-side end of the indoor heat exchanger 52*a* or the temperature Trg of refrigerant at the gas-side end of the indoor heat exchanger 52*a* in this modification) may be made lower than or equal to the atmosphere temperature Tra of the heating-stopped indoor heat exchanger 52*b*.

Meanwhile, the temperature Trl or Trg of refrigerant flowing in the heating-stopped indoor heat exchanger 52*b* fluctuates by being influenced by a pressure of refrigerant flowing between the liquid-side indoor expansion valve 51*b* and the outdoor heat exchanger 23 (see points H' and G' in FIG. 6). Accordingly, for example, in a case where a saturation temperature corresponding to the pressure of refrigerant flowing between the liquid-side indoor expansion valve 51*b* and the outdoor heat exchanger 23 is much higher than the atmosphere temperature Tra of the heating-stopped indoor heat exchanger 52*b*, even if the opening degrees of the liquid-side indoor expansion valve 51*b* and the gas-side indoor expansion valve 61*b* are controlled in the above manner, it is not possible to make the temperature Trl or Trg of refrigerant flowing in the heating-stopped indoor heat exchanger 52*b* become lower than or equal to the atmosphere temperature Tra of the heating-stopped indoor heat exchanger 52*b* in some cases.

Therefore, in this modification, as illustrated in FIG. 6, in a case where both the heating-operation indoor heat exchanger 52*a* and the heating-stopped indoor heat exchanger 52*b* are present, the control unit 19 controls the opening degrees of the liquid-side indoor expansion valve 51*b* and the gas-side indoor expansion valve 61*b* in the above manner and also controls the opening degree of the outdoor expansion valve 25 such that the temperature Trl or Trg of refrigerant flowing in the heating-stopped indoor heat exchanger 52*b* becomes lower than or equal to the atmosphere temperature Tra of the heating-stopped indoor heat exchanger 52*b*. Specifically, the control unit 19 controls the opening of the outdoor expansion valve 25 such that the temperature Trg of refrigerant in the heating-stopped indoor heat exchanger 52*b* becomes lower than or equal to the indoor temperature Tra. Although the temperature Trg is used as the temperature of refrigerant in the heating-stopped indoor heat exchanger 52*b* in this modification, the temperature Trl may also be used.

Thus, in this modification, it is possible to make the temperature Trl or Trg of refrigerant flowing in the heating-stopped indoor heat exchanger 52*b* become lower than or equal to the atmosphere temperature Tra of the heating-stopped indoor heat exchanger 52*b* so that the radiation loss from the heating-stopped indoor heat exchanger 52*b* can be reliably suppressed.

(4) Second Modification

In order to reliably suppress the radiation loss from the heating-stopped indoor heat exchanger 52*b* in the control where some of the indoor units does not perform heating operation in the above embodiment (see FIGS. 5 and 6), the temperature Trl or Trg of refrigerant flowing in the heating-stopped indoor heat exchanger 52*b* may be made lower than or equal to the atmosphere temperature Tra of the heating-stopped indoor heat exchanger 52*b*.

However, if the temperature Trl or Trg of refrigerant flowing in the heating-stopped indoor heat exchanger 52*b* is much lower than the atmosphere temperature Tra of the heating-stopped indoor heat exchanger 52*b*, the refrigerant flowing in the heating-stopped indoor heat exchanger 52*b* may cool the atmosphere (the indoor air in this modification) of the heating-stopped indoor heat exchanger 52*b*, which may result in generation of a cold draft from the heating-stopped indoor heat exchanger 52*b*. In order to prevent the generation of such a cold draft from the heating-stopped indoor heat exchanger 52*b*, the temperature Trl or Trg of refrigerant flowing in the heating-stopped indoor heat exchanger 52*b* is preferably made higher than or equal to the atmosphere temperature Tra of the heating-stopped indoor heat exchanger 52*b*.

Meanwhile, the temperature Trl or Trg of refrigerant flowing in the heating-stopped indoor heat exchanger 52*b* fluctuates by being influenced by the pressure of refrigerant flowing between the liquid-side indoor expansion valve 51*b* and the outdoor heat exchanger 52*b* (see points H' and G' in FIG. 6). Accordingly, for example, in a case where a saturation temperature corresponding to the pressure of refrigerant flowing between the liquid-side indoor expansion valve 51*b* and the outdoor heat exchanger 23 is much lower than the atmosphere temperature Tra of the heating-stopped indoor heat exchanger 52*b*, even if the opening degrees of the liquid-side indoor expansion valve 51*b* and the gas-side indoor expansion valve 61*b* are controlled in the above manner, it is not possible to make the temperature Trl or Trg of refrigerant flowing in the heating-stopped indoor heat exchanger 52*b* become higher than or equal to the atmosphere temperature Tra of the heating-stopped indoor heat exchanger 52*b* in some cases.

Figure 7:
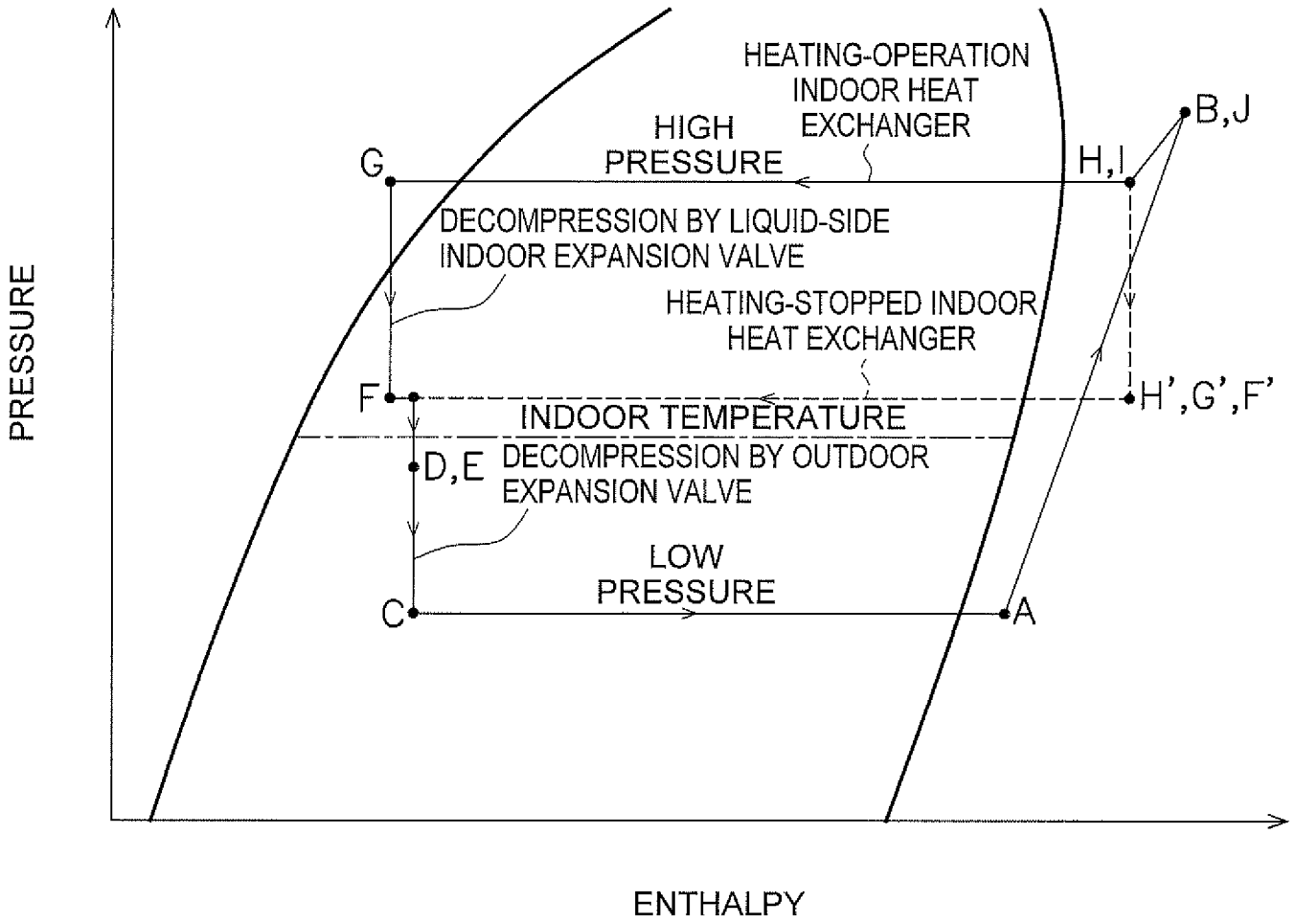
FIG. 7 is a pressure-enthalpy diagram illustrating a refrigeration cycle during heating operation in a case where both the heating-operation indoor heat exchanger and the heating-stopped indoor heat exchanger are present in the air conditioner according to the embodiment and the second modification of the present invention.

Therefore, in this modification, as illustrated in FIG. 7, in a case where both the heating-operation indoor heat exchanger 52*a* and the heating-stopped indoor heat exchanger 52*b* are present, the control unit 19 controls the opening degrees of the liquid-side indoor expansion valve 51*b* and the gas-side indoor expansion valve 61*b* in the above manner and also controls the opening degree of the outdoor expansion valve 25 such that the temperature Trl or Trg of refrigerant in the heating-stopped indoor heat exchanger 52*b* becomes higher than or equal to the atmosphere temperature Tra of the heating-stopped indoor heat exchanger 52*b*. Specifically, the control unit 19 controls the opening of the outdoor expansion valve 25 such that the temperature Trg of refrigerant in the heating-stopped indoor heat exchanger 52*b* becomes higher than or equal to the indoor temperature Tra. Although the temperature Trg is used as the temperature of refrigerant in the heating-stopped indoor heat exchanger 52*b* in this modification, the temperature Trl may also be used.

Thus, in this modification, it is possible to make the temperature Trl or Trg of refrigerant flowing in the heating-stopped indoor heat exchanger 52*b* become higher than or equal to the atmosphere temperature Tra of the heating-stopped indoor heat exchanger 52*b* so that the radiation loss from the heating-stopped indoor heat exchanger 52*b* and the cold draft from the heating-stopped indoor heat exchanger 52*b* can be suppressed. Note that in order to reliably suppress both the radiation loss and the cold draft from the heating-stopped indoor heat exchanger 52*b*, the opening degree of the outdoor expansion valve 25 is preferably controlled such that the temperature Trl or Trg of refrigerant in the heating-stopped indoor heat exchanger 52*b* becomes equal to the atmosphere temperature Tra of the heating-stopped indoor heat exchanger 52*b*. Specifically, the control unit 19 controls the opening degree of the outdoor expansion valve 25 such that the temperature Trg or Trl of refrigerant in the heating-stopped indoor heat exchanger 52*b* becomes equal to the atmosphere temperature Tra.

(5) Third Modification

In the air conditioner 1 (see FIG. 1) according to the above embodiment and the first and second modifications, cooling operation is performed under a condition that the outside air temperature is low and the load is small (hereinafter referred to as "low-outside-air-temperature small-load cooling operation") in some cases.

During such low-outside-air-temperature small-load cooling operation, a difference between a high pressure and a low pressure of the compressor 21 may become too small, which results in failure of continuation of the cooling operation.

Figure 8:
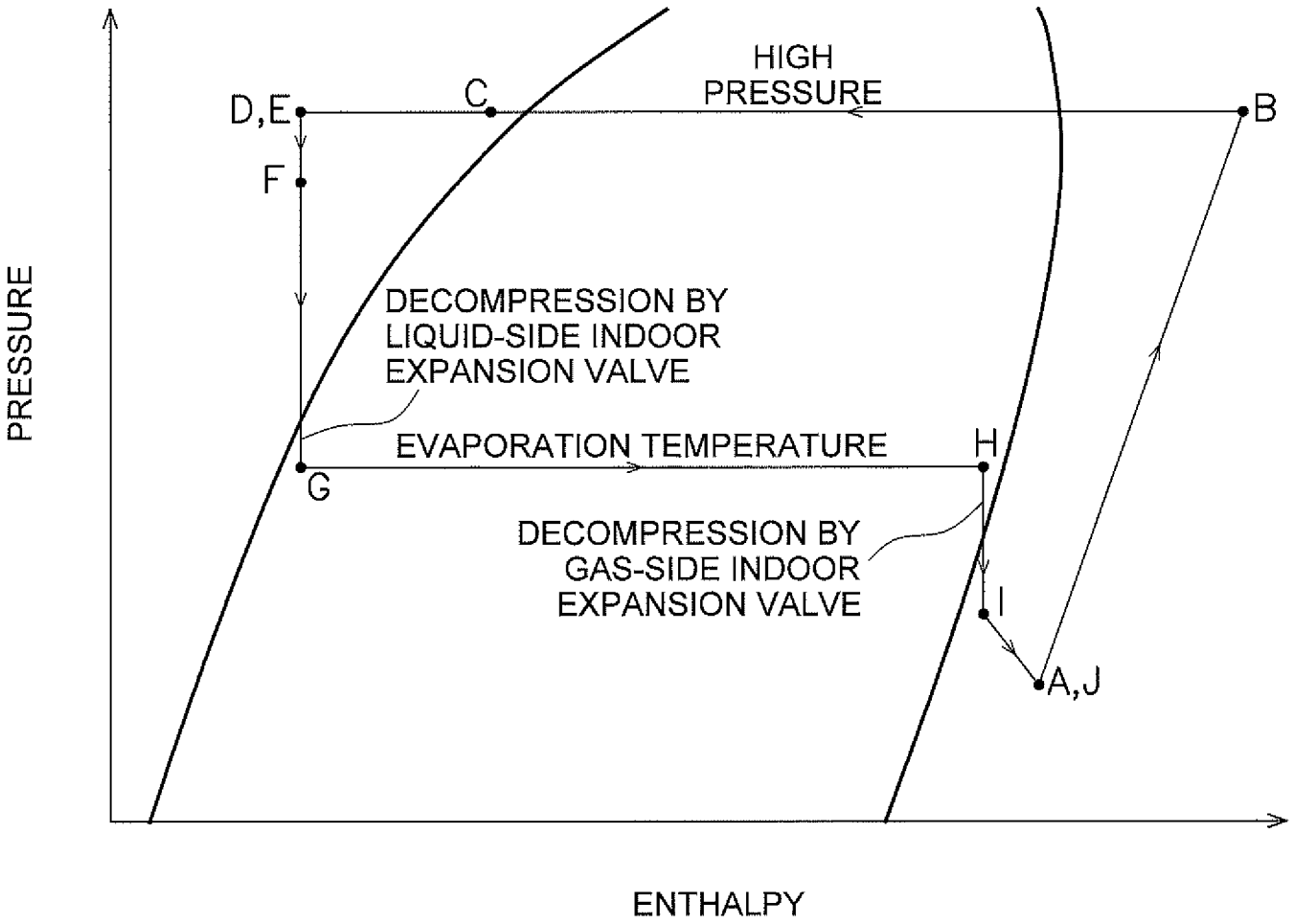
FIG. 8 is a pressure-enthalpy diagram illustrating a refrigeration cycle during cooling operation of an air conditioner according to a third modification of the present invention.

Therefore, in this modification, during cooling operation, the control unit 19 controls the opening degrees of the gas-side indoor expansion valves 61*a* and 61*b* on the basis of an evaporation temperature Tre of refrigerant in the indoor heat exchangers 52*a* and 52*b*. Specifically, the control unit 19 determines whether a difference ΔP between the high pressure and the low pressure of the compressor 21 becomes smaller than a predetermined value ΔPm. Note that the difference ΔP between the high pressure and the low pressure is obtained by subtracting the suction pressure Ps from the discharge pressure Pd. If the control unit 19 determines that the difference ΔP between the high pressure and the low pressure of the compressor 21 becomes smaller than the predetermined value ΔPm, the control unit 19 controls the opening degrees of the gas-side indoor expansion valves 61*a* and 61*b* such that the evaporation temperature Tre of refrigerant becomes a target evaporation temperature Tret. As the evaporation temperature Tre of refrigerant in this modification, the temperature Trl of refrigerant at the liquid-side end of the indoor heat exchangers 52*a* and 52*b* is used. As illustrated in FIG. 8, this control can decompress the refrigerant in the gas-side indoor expansion valves 61*a* and 61*b* (see points H and I in FIG. 8), thereby can decrease the suction pressure Ps of the compressor 21 (see points A and J in FIG. 8), and can maintain a sufficient difference ΔP between the high pressure and the low pressure of the compressor 21.

Thus, in this modification, even under an operation condition where the difference ΔP between the high pressure and the low pressure of the compressor 21 is likely to be decreased, such as in the low-outside-air-temperature small-load cooling operation, it is possible to perform a stable cooling operation while maintaining a sufficient difference ΔP between the high pressure and the low pressure of the compressor 21.

(6) Fourth Modification

In the air conditioner 1 (see FIG. 1) according to the above embodiment and the first to third modifications, by closing the liquid-side indoor expansion valves 51*a* and 51*b* and the gas-side indoor expansion valves 61*a* and 61*b*, refrigerant can be prevented from flowing into the indoor units 3*a* and 3*b* from the refrigerant communication pipes 5 and 6 side.

Figure 9:
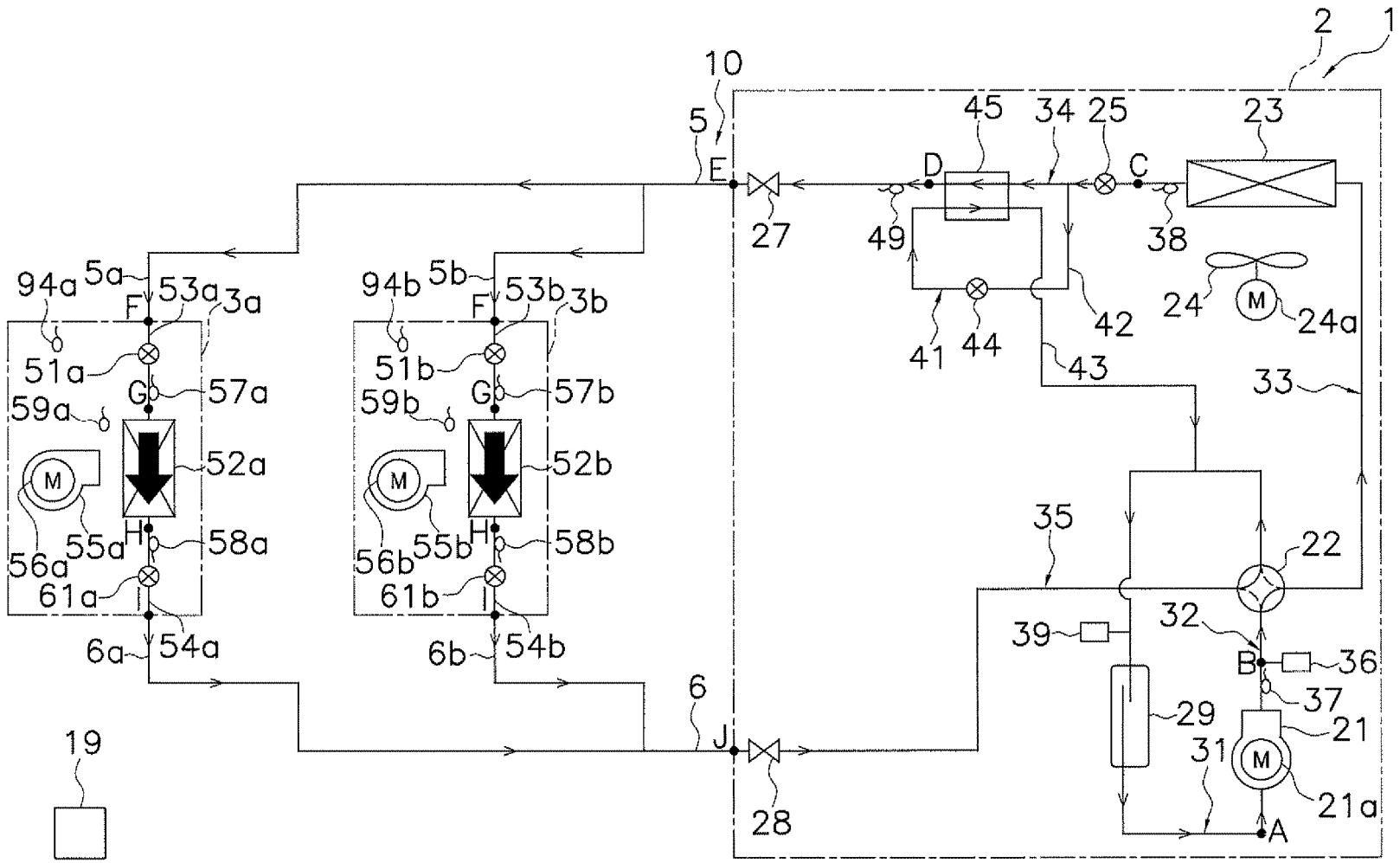
FIG. 9 schematically illustrates a configuration of an air conditioner according to a fourth modification of the present invention.
Figure 10:
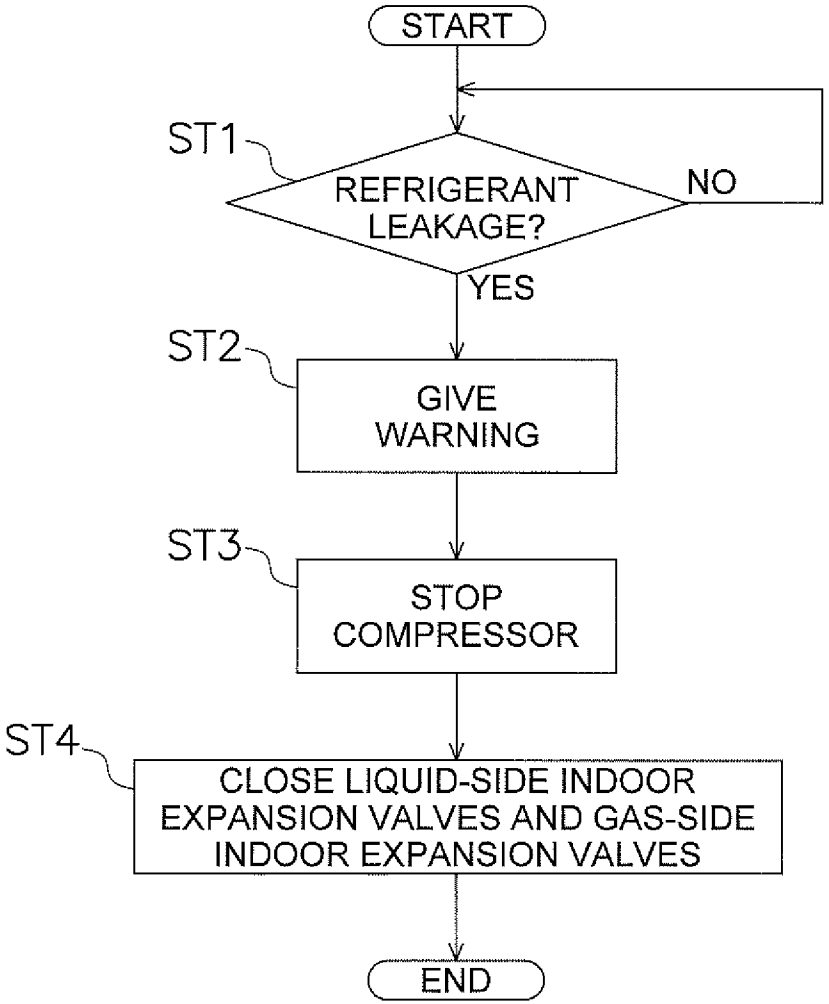
FIG. 10 is a flowchart illustrating a process in a case where refrigerant leaks in the air conditioner according to the fourth modification of the present invention.

Specifically, as illustrated in FIG. 9, refrigerant sensors 94*a* and 94*b* are provided in the indoor units 3*a* and 3*b* as refrigerant leakage detecting means that detects leakage of the refrigerant, and as illustrated in FIG. 10, if the refrigerant sensors 94*a* and 94*b* detect leakage of the refrigerant (step ST1), the control unit 19 closes the liquid-side indoor expansion valves 51*a* and 51*b* and the gas-side indoor expansion valves 61*a* and 61*b* (step ST4). Note that the liquid-side indoor expansion valves 51*a* and 51*b* and the gas-side indoor expansion valves 61*a* and 61*b* are preferably closed at the same time in step ST4. However, in a case where the liquid-side indoor expansion valves 51*a* and 51*b* and the gas-side indoor expansion valves 61*a* and 61*b* are closed sequentially, the liquid-side indoor expansion valves 51*a* and 51*b* are preferably closed first, putting priority on preventing a liquid refrigerant from flowing into the indoor units 3*a* and 3*b* from the liquid-refrigerant communication pipe 5 side. In addition, the refrigerant leakage detecting means may be the refrigerant sensors 94*a* and 94*b* described above, which directly detect leakage of the refrigerant, or may be any device that determines whether the refrigerant has leaked or estimates its amount on the basis of a relationship between the temperature (e.g., the indoor heat exchanger temperature Trl or Trg) of refrigerant in the indoor heat exchangers 52*a* and 52*b* and the atmosphere temperature (e.g., the indoor temperature Tra) of the indoor heat exchangers 52*a* and 52*b*, for example. In addition, the location where the refrigerant sensors 94*a* and 94*b* are installed is not limited to the indoor units 3*a* and 3*b*, and may be remote controls for controlling the indoor units 3*a* and 3*b*, air-conditioned indoor spaces, and the like.

Thus, in this modification, if the refrigerant leakage detecting means detects leakage of the refrigerant, the liquid-side indoor expansion valves 51*a* and 51*b* and the gas-side indoor expansion valves 61*a* and 61*b* are closed. Therefore, it is possible to prevent the refrigerant from flowing into the indoor units 3*a* and 3*b* from the refrigerant communication pipes 5 and 6 side and to suppress an increase in the concentration of refrigerant in indoor spaces.

If leakage of the refrigerant is detected in step ST1, a warning may be given (step ST2).

In addition, before closing the liquid-side indoor expansion valves 51*a* and 51*b* and the gas-side indoor expansion valves 61*a* and 61*b*, the compressor 21 may be stopped (step ST3) so as to suppress an excessive increase in the pressure of refrigerant.

(7) Fifth Modification

In the air conditioner 1 (see FIG. 9) according to the fourth modification, in a case where the liquid-side indoor expansion valves 51*a* and 51*b* and the gas-side indoor expansion valves 61*a* and 61*b* are fully closed if the refrigerant leakage detecting means 94*a* and 94*b* detects leakage of the refrigerant, the indoor heat exchanger in which the refrigerant has not leaked is in a liquid-sealed state, which may result in an excessive increase in the pressure of refrigerant in the indoor heat exchanger.

Figure 11:
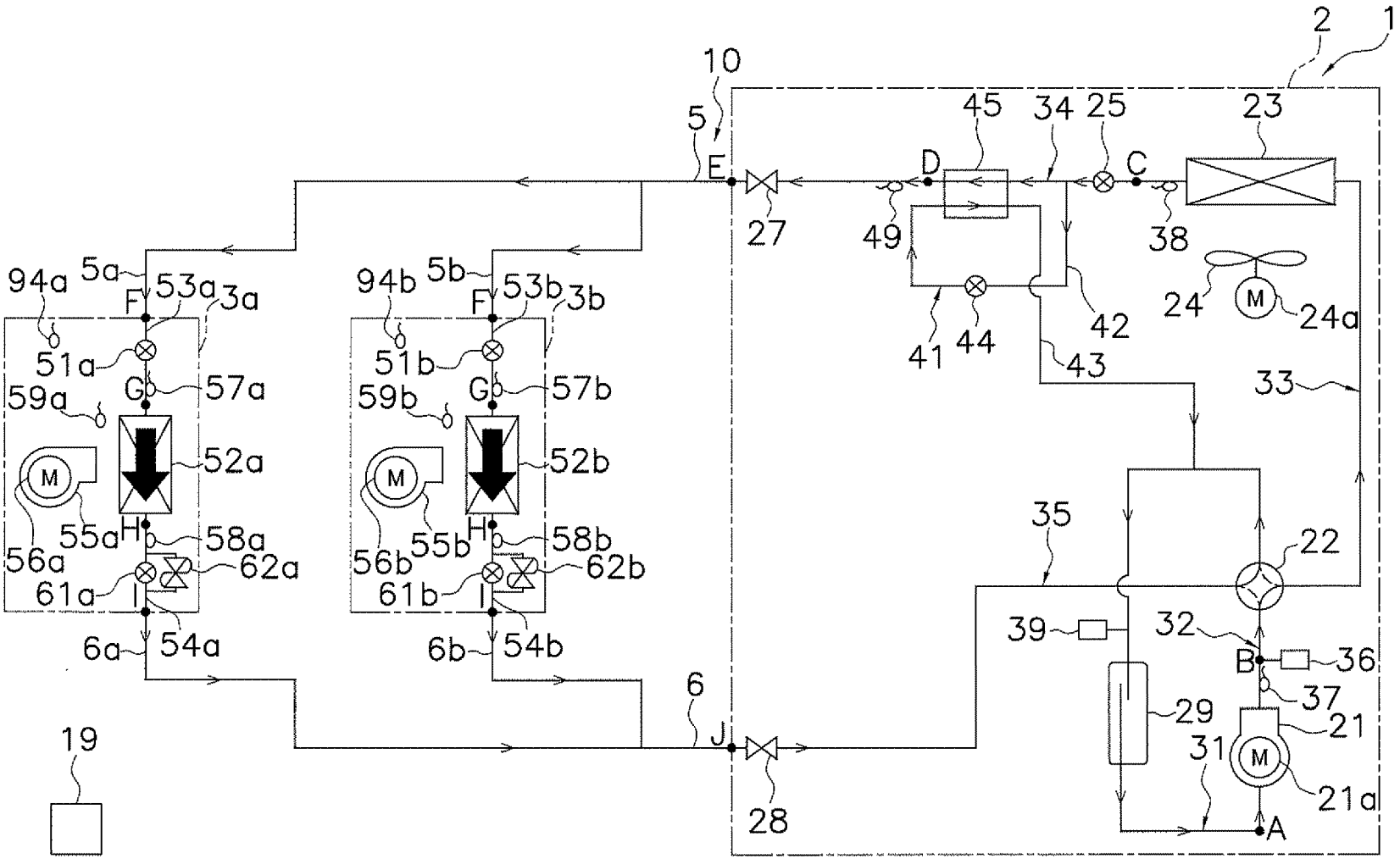
FIG. 11 schematically illustrates a configuration of an air conditioner according to a fifth modification of the present invention.

Accordingly, in this modification, as illustrated in FIG. 11, pressure adjusting valves 62*a* and 62*b* are provided so as to bypass the gas-side indoor expansion valves 61*a* and 61*b*. The pressure adjusting valves 62*a* and 62*b* open when the pressure of refrigerant in the indoor heat exchangers 52*a* and 52*b* increases to a predetermined pressure. Therefore, in this modification, if the pressure of refrigerant in the indoor heat exchangers 52*a* and 52*b* increases to a predetermined pressure by fully closing the liquid-side indoor expansion valves 51*a* and 51*b* and the gas-side indoor expansion valves 61*a* and 61*b*, the pressure adjusting valves 62*a* and 62*b* open so as to release refrigerant to the gas-refrigerant communication pipe 6 side, and thereby it is possible to prevent that the indoor heat exchanger in which the refrigerant has not leaked is in a liquid-sealed state.

Note that the pressure adjusting valves 62*a* and 62*b* may be provided so as to bypass the liquid-side indoor expansion valves 51*a* and 51*b* instead of the gas-side indoor expansion valves 61*a* and 61*b*. Alternatively, instead of providing the pressure adjusting valves 62*a* and 62*b*, expansion valves having a function of preventing a liquid-sealed state may be employed as the liquid-side indoor expansion valves 51*a* and 51*b* and the gas-side indoor expansion valves 61*a* and 61*b*.

(8) Sixth Modification

Figure 12:
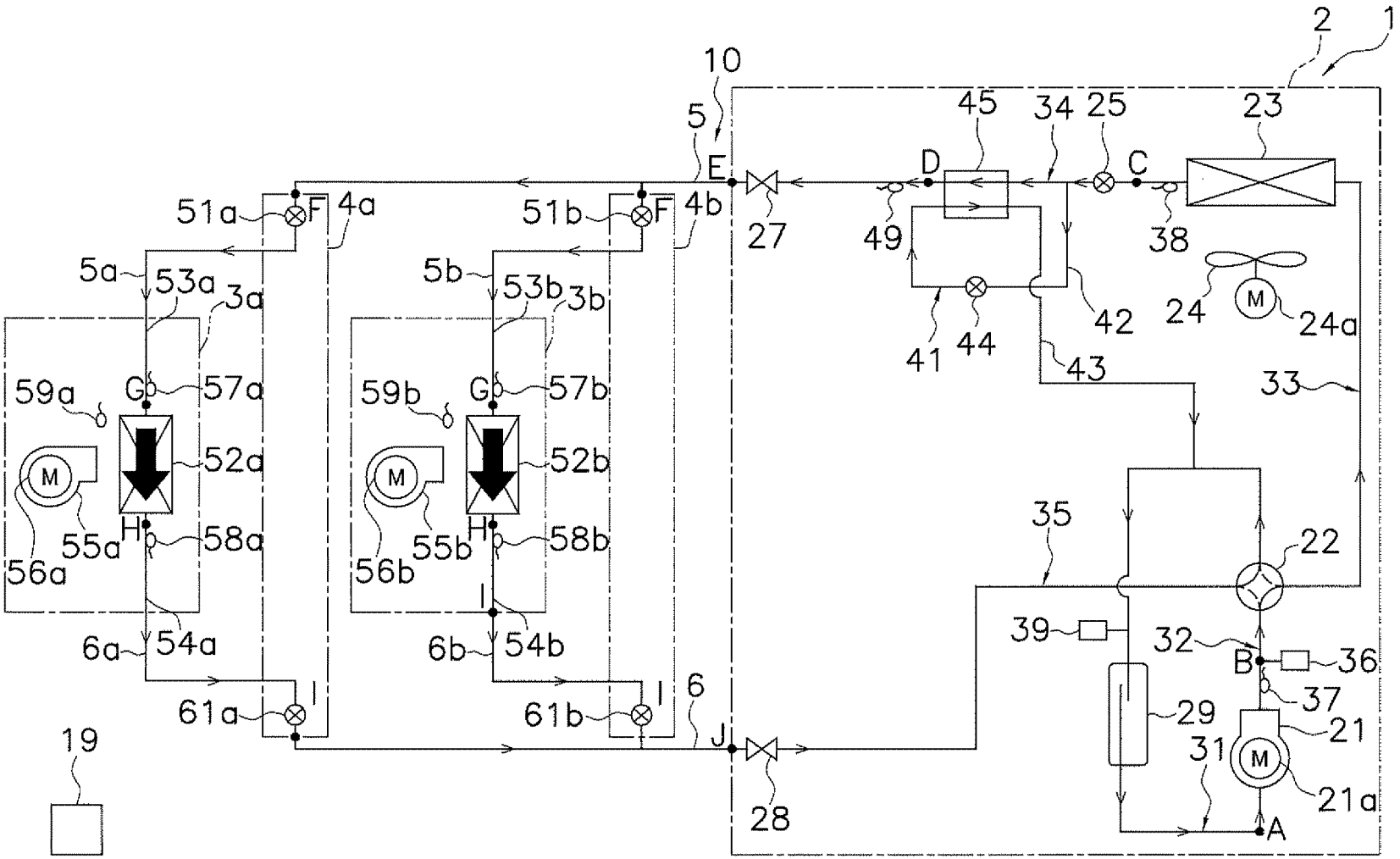
FIG. 12 schematically illustrates a configuration of an air conditioner according to a sixth modification of the present invention.

In the air conditioner (see FIGS. 1, 9, and 11) according to the above embodiment and the first to fifth modifications, the liquid-side indoor expansion valves 51*a* and 51*b* and the gas-side indoor expansion valves 61*a* and 61*b* are provided in the indoor units 3*a* and 3*b*. However, a specific configuration is not limited to these configurations, external expansion valve units 4*a* and 4*b* including the liquid-side indoor expansion valves 51*a* and 51*b* and the gas-side indoor expansion valves 61*a* and 61*b* may be provided at the branch pipe portions 5*a*, 5*b*, 6*a*, and 6*b* in the refrigerant communication pipes 5 and 6, for example, as illustrated in FIG. 12.

(9) Other Modifications

In the air conditioner (see FIGS. 1, 9, and 11) according to the above embodiment and the first to sixth modifications, the refrigerant returning pipe 41 and the refrigerant cooler 45 are provided in the outdoor unit 2. However, a specific configuration is not limited to these configurations, the refrigerant returning pipe 41 and the refrigerant cooler 45 may be omitted or other components other than the refrigerant returning pipe 41 and the refrigerant cooler 45 may be further included.

INDUSTRIAL APPLICABILITY

The present invention is widely applicable to an air conditioner including a refrigerant circuit and a control unit, the refrigerant circuit being constituted by connecting a compressor, a plurality of indoor heat exchangers that are parallel with each other, liquid-side indoor expansion valves corresponding to a liquid side of the respective indoor heat exchangers, and an outdoor heat exchanger, the control unit performing heating operation in which refrigerant sealed in the refrigerant circuit is circulated in the order of the compressor, the indoor heat exchangers, the liquid-side indoor expansion valves, and the outdoor heat exchanger.

REFERENCE SIGNS LIST

1 air conditioner
3*a*, 3*b* indoor unit
10 refrigerant circuit
19 control unit
21 compressor
23 outdoor heat exchanger
25 outdoor expansion valve
51*a*, 51*b* liquid-side indoor expansion valve
52*a*, 52*b* indoor heat exchanger
61*a*, 61*b* gas-side indoor expansion valve
62*a*, 62*b* pressure adjusting valve
94*a*, 94*b* refrigerant leakage detecting means

CITATION LIST

Patent Literature

[PTL 1] Japanese Unexamined Patent Application Publication No. 7-310962

The invention claimed is:

1. An air conditioner comprising:

a refrigerant circuit constituted by connecting a compressor, a plurality of indoor heat exchangers that are parallel with each other, liquid-side indoor expansion valves corresponding to a liquid side of the respective indoor heat exchangers, and an outdoor heat exchanger; and a controller configured to perform a heating operation in which refrigerant sealed in the refrigerant circuit is circulated in an order of the compressor, the indoor heat exchangers, the liquid-side indoor expansion valves, and the outdoor heat exchanger, wherein the refrigerant circuit further includes gas-side indoor expansion valves corresponding to a gas side of the respective indoor heat exchangers, wherein, in a case where the indoor heat exchangers include both a heating-operation indoor heat exchanger that performs the heating operation and a heating-stopped indoor heat exchanger that does not perform the heating operation, the controller is further configured to control the liquid-side indoor expansion valve and the gas-side indoor expansion valve corresponding to the heating-stopped indoor heat exchanger such that an opening degree of the gas-side indoor expansion valve becomes smaller than an opening degree of the liquid-side indoor expansion valve thus causing gas refrigerant to flow from the gas-side indoor expansion valve into the heating-stopped indoor heat exchanger at a lower pressure than gas refrigerant flowing from the gas-side indoor expansion valve into the heating-operation indoor heat exchanger.

2. The air conditioner according to claim 1, wherein the controller controls the gas-side indoor expansion valve corresponding to the heating-operation indoor heat exchanger such that the opening degree of the gas-side indoor expansion valve becomes fully open.

3. The air conditioner according to claim 1, wherein the controller controls the gas-side indoor expansion valve corresponding to the heating-stopped indoor heat exchanger such that the opening degree of the gas-side indoor expansion valve becomes 15% or less of a fully open state of the gas-side indoor expansion valve.

4. The air conditioner according to claim 1, wherein the controller controls the liquid-side indoor expansion valve corresponding to the heating-stopped indoor heat exchanger such that the opening degree of the liquid-side indoor expansion valve becomes fully open.

5. The air conditioner according to claim 1, wherein the refrigerant circuit further includes an outdoor expansion valve between the liquid-side indoor expansion valves and the outdoor heat exchanger, and wherein the controller controls an opening degree of the outdoor expansion valve such that a temperature of the refrigerant in the heating-stopped indoor heat exchanger becomes lower than or equal to an atmosphere temperature of the heating-stopped indoor heat exchanger.

6. The air conditioner according to claim 1, wherein the refrigerant circuit further includes an outdoor expansion valve between the liquid-side indoor expansion valves and the outdoor heat exchanger, and wherein the controller controls an opening degree of the outdoor expansion valve such that a temperature of the refrigerant in the heating-stopped indoor heat exchanger becomes higher than or equal to an atmosphere temperature of the heating-stopped indoor heat exchanger.

7. The air conditioner according to claim 1, wherein the controller performs cooling operation in which the refrigerant sealed in the refrigerant circuit is circulated in an order of the compressor, the outdoor heat exchanger, the liquid-side indoor expansion valves, and the indoor heat exchangers and controls opening degrees of the gas-side indoor expansion valves on the basis of an evaporation temperature of the refrigerant in the indoor heat exchangers.

8. The air conditioner according to claim 1, wherein the respective indoor heat exchangers are provided in indoor units, wherein the air conditioner is further provided with refrigerant leakage detector that detects leakage of the refrigerant, and wherein, if the refrigerant leakage detector detects leakage of the refrigerant, the controller controls the liquid-side indoor expansion valves and the gas-side indoor expansion valves such that opening degrees of the liquid-side indoor expansion valves and the gas-side indoor expansion valves become fully closed.

9. The air conditioner according to claim 8, wherein, before controlling the liquid-side indoor expansion valves and the gas-side indoor expansion valves to be fully closed, the controller stops the compressor.

10. The air conditioner according to claim 8, wherein the refrigerant circuit further includes pressure adjusting valves that are provided to bypass the respective gas-side indoor expansion valves or the respective liquid-side indoor expansion valves and that open when a pressure of the refrigerant in the indoor heat exchangers increases to a predetermined pressure.

11. The air conditioner according to claim 2, wherein the controller controls the gas-side indoor expansion valve corresponding to the heating-stopped indoor heat exchanger such that the opening degree of the gas-side indoor expansion valve becomes 15% or less of a fully open state of the gas-side indoor expansion valve.

12. The air conditioner according to claim 2, wherein the controller controls the liquid-side indoor expansion valve corresponding to the heating-stopped indoor heat exchanger such that the opening degree of the liquid-side indoor expansion valve becomes fully open.

13. The air conditioner according to claim 3, wherein the controller controls the liquid-side indoor expansion valve corresponding to the heating-stopped indoor heat exchanger such that the opening degree of the liquid-side indoor expansion valve becomes fully open.

14. The air conditioner according to claim 2, wherein the refrigerant circuit further includes an outdoor expansion valve between the liquid-side indoor expansion valves and the outdoor heat exchanger, and wherein the controller controls an opening degree of the outdoor expansion valve such that a temperature of the refrigerant in the heating-stopped indoor heat exchanger becomes lower than or equal to an atmosphere temperature of the heating-stopped indoor heat exchanger.

15. The air conditioner according to claim 3, wherein the refrigerant circuit further includes an outdoor expansion valve between the liquid-side indoor expansion valves and the outdoor heat exchanger, and wherein the controller controls an opening degree of the outdoor expansion valve such that a temperature of the refrigerant in the heating-stopped indoor heat exchanger becomes lower than or equal to an atmosphere temperature of the heating-stopped indoor heat exchanger.

16. The air conditioner according to claim 4, wherein the refrigerant circuit further includes an outdoor expansion valve between the liquid-side indoor expansion valves and the outdoor heat exchanger, and wherein the controller controls an opening degree of the outdoor expansion valve such that a temperature of the refrigerant in the heating-stopped indoor heat exchanger becomes lower than or equal to an atmosphere temperature of the heating-stopped indoor heat exchanger.

17. The air conditioner according to claim 2, wherein the refrigerant circuit further includes an outdoor expansion valve between the liquid-side indoor expansion valves and the outdoor heat exchanger, and wherein the controller controls an opening degree of the outdoor expansion valve such that a temperature of the refrigerant in the heating-stopped indoor heat exchanger becomes higher than or equal to an atmosphere temperature of the heating-stopped indoor heat exchanger.

18. The air conditioner according to claim 3, wherein the refrigerant circuit further includes an outdoor expansion valve between the liquid-side indoor expansion valves and the outdoor heat exchanger, and wherein the controller controls an opening degree of the outdoor expansion valve such that a temperature of the refrigerant in the heating-stopped indoor heat exchanger becomes higher than or equal to an atmosphere temperature of the heating-stopped indoor heat exchanger.

19. The air conditioner according to claim 4, wherein the refrigerant circuit further includes an outdoor expansion valve between the liquid-side indoor expansion valves and the outdoor heat exchanger, and wherein the controller controls an opening degree of the outdoor expansion valve such that a temperature of the refrigerant in the heating-stopped indoor heat exchanger becomes higher than or equal to an atmosphere temperature of the heating-stopped indoor heat exchanger.

20. The air conditioner according to claim 1, wherein the controller performs cooling operation in which the refrigerant sealed in the refrigerant circuit is circulated in an order of the compressor, the outdoor heat exchanger, the liquid-side indoor expansion valves, and the indoor heat exchangers and controls opening degrees of the gas-side indoor expansion valves on the basis of an evaporation temperature of the refrigerant in the indoor heat exchangers.

21. The air conditioner according to claim 1, wherein each of the plurality of indoor heat exchangers is housed in a separate indoor unit from the others of the plurality of indoor heat exchangers, and wherein the liquid-side indoor expansion valve corresponding to the heating-stopped indoor heat exchanger is the only liquid-side indoor expansion valve provided in the indoor unit housing the heating-stopped indoor heat exchanger.

* * * * *